US012091233B2

(12) United States Patent
Melchor

(10) Patent No.: US 12,091,233 B2
(45) Date of Patent: Sep. 17, 2024

(54) PRODUCT BOX SUITABLE FOR RECEIVING TEMPERATURE-SENSITIVE MATERIALS AND SHIPPING SYSTEM INCLUDING THE SAME

(71) Applicant: Cold Chain Technologies, LLC, Franklin, MA (US)

(72) Inventor: Henry R. Melchor, Woonsocket, RI (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 499 days.

(21) Appl. No.: 17/213,040

(22) Filed: Mar. 25, 2021

(65) Prior Publication Data

US 2021/0300665 A1 Sep. 30, 2021

Related U.S. Application Data

(60) Provisional application No. 62/994,599, filed on Mar. 25, 2020.

(51) Int. Cl.
*B65D 81/38* (2006.01)
*B65D 5/02* (2006.01)
*B65D 81/18* (2006.01)

(52) U.S. Cl.
CPC ..... *B65D 81/3825* (2013.01); *B65D 5/0236* (2013.01); *B65D 81/18* (2013.01)

(58) Field of Classification Search
CPC .. B65D 81/3825; B65D 5/0236; B65D 81/18; B65D 81/3827; B65D 81/3834;
(Continued)

(56) References Cited

U.S. PATENT DOCUMENTS 2,090,882 A * 8/1937 Zimmerman ..... B65D 71/36 206/168
5,100,016 A * 3/1992 Wischusen, III ..... B65D 5/248 428/167

(Continued)

FOREIGN PATENT DOCUMENTS

WO 2018213348 A2 11/2018

OTHER PUBLICATIONS

U.S. Appl. No. 17/668,569, inventors William C. Blezard et al., filed Feb. 10, 2022 (available in USPTO's IFW system).

(Continued)

*Primary Examiner* — Christopher R Demeree
(74) *Attorney, Agent, or Firm* — KRIEGSMAN & KRIEGSMAN

(57) ABSTRACT

Product box for use in a shipping system for temperature-sensitive materials and shipping system including the product box. In one embodiment, the product box includes a front, a rear, a left side, and a right side. The upper edges of the front and the rear are higher than the upper edges of the left side and the right side. The box also includes upper flaps hingedly connected to the upper edges of each of the front, the rear, the left side, and the right side and further includes lower flaps hingedly connected to the lower edges of each of the front and the rear. When folded, the upper flaps of the front and the rear are spaced above the upper flaps of the left side and the right side, thereby forming an air gap. Wings at the upper edges of the four sides center the product box within a container.

10 Claims, 35 Drawing Sheets

(58) Field of Classification Search
CPC .... B65D 5/4295; B65D 5/22; B65D 81/3858; B65D 5/2057; B65D 81/3823; B65D 25/02; B65D 5/5028; B65D 5/68; F25D 2303/0844; F25D 3/08; F25D 2303/084; F25D 2303/0843; F25D 2303/0845; F25D 3/06; Y02W 90/10
USPC ..... 229/164, 103.11, 194, 117.13, 117.16, 229/126, 150, 916; 206/594, 509; 220/4.33, 592.25
See application file for complete search history.

(56) References Cited

U.S. PATENT DOCUMENTS

| | | | | |
|---|---|---|---|---|
| 5,193,701 | A * | 3/1993 | Bush | B65D 9/24 229/164 |
| 5,899,088 | A | 5/1999 | Purdum | |
| 5,924,302 | A | 7/1999 | Derifield | |
| 6,116,042 | A | 9/2000 | Purdum | |
| 6,482,332 | B1 | 11/2002 | Malach | |
| 6,868,982 | B2 | 3/2005 | Gordon | |
| 6,875,486 | B2 | 4/2005 | Miller | |
| 7,140,768 | B2 | 11/2006 | Prabhakar | |
| 7,257,963 | B2 | 8/2007 | Mayer | |
| 7,849,708 | B2 | 12/2010 | Goncharko et al. | |
| 8,074,465 | B2 | 12/2011 | Heroux et al. | |
| 8,250,882 | B2 | 8/2012 | Mustafa et al. | |
| 8,607,581 | B2 | 12/2013 | Williams et al. | |
| 8,613,202 | B2 | 12/2013 | Williams | |
| 8,763,886 | B2 * | 7/2014 | Hall | B65D 5/0227 220/592.25 |
| 8,887,515 | B2 | 11/2014 | Patstone | |
| 8,938,986 | B2 | 1/2015 | Matta et al. | |
| 9,045,278 | B2 | 6/2015 | Mustafa et al. | |
| 9,180,998 | B2 | 11/2015 | Banks et al. | |
| 9,366,469 | B2 | 6/2016 | Chapman, Jr. | |
| 9,429,350 | B2 | 8/2016 | Chapman, Jr. | |
| 9,556,373 | B2 | 1/2017 | Formato et al. | |
| 9,598,622 | B2 | 3/2017 | Formato et al. | |
| 9,738,420 | B2 * | 8/2017 | Miller | B65D 81/24 |
| 9,944,449 | B2 | 4/2018 | Wood et al. | |
| 10,077,389 | B2 | 9/2018 | Formato et al. | |
| 10,583,978 | B2 | 3/2020 | Longley et al. | |
| 10,604,326 | B2 | 3/2020 | Longley et al. | |
| 10,661,969 | B2 | 5/2020 | Pranadi et al. | |
| 10,829,675 | B2 | 11/2020 | Formato et al. | |
| 10,962,270 | B2 | 3/2021 | Jain et al. | |
| 11,137,190 | B2 | 10/2021 | Martino | |
| 11,340,005 | B2 | 5/2022 | Nilsen et al. | |
| 2011/0100868 | A1 * | 5/2011 | Lantz | B65D 81/3853 206/584 |
| 2011/0290792 | A1 | 12/2011 | Krzak et al. | |
| 2012/0248101 | A1 | 10/2012 | Tumber et al. | |
| 2012/0279896 | A1 * | 11/2012 | Lantz | B65D 25/16 53/473 |
| 2016/0362240 | A1 | 12/2016 | Ferracamo, Jr. | |
| 2017/0121097 | A1 | 5/2017 | Pranadi et al. | |
| 2018/0093816 | A1 | 4/2018 | Longley et al. | |
| 2018/0100682 | A1 | 4/2018 | Nilsen et al. | |
| 2018/0320947 | A1 | 11/2018 | Jain et al. | |
| 2018/0328644 | A1 | 11/2018 | Rizzo et al. | |
| 2019/0210790 | A1 | 7/2019 | Rizzo et al. | |
| 2020/0002075 | A1 | 1/2020 | Lee et al. | |
| 2020/0047993 | A1 | 2/2020 | Brabbs et al. | |
| 2020/0148452 | A1 * | 5/2020 | Sollie | B65D 5/5028 |
| 2020/0231362 | A1 | 7/2020 | Kulangara et al. | |
| 2020/0307896 | A1 | 10/2020 | Pranadi et al. | |
| 2020/0324959 | A1 | 10/2020 | Longley et al. | |
| 2020/0331686 | A1 | 10/2020 | Longley et al. | |
| 2020/0408453 | A1 | 12/2020 | Martino | |
| 2021/0024270 | A1 | 1/2021 | Mirzaee Kakhki | |
| 2021/0070539 | A1 | 3/2021 | Chasteen et al. | |
| 2021/0292630 | A1 | 9/2021 | Formato et al. | |
| 2021/0331834 | A1 | 10/2021 | Longley et al. | |
| 2022/0002070 | A1 | 1/2022 | Moghaddas et al. | |
| 2022/0265514 | A1 | 8/2022 | Blezard et al. | |
| 2022/0267657 | A1 | 8/2022 | Blezard et al. | |

OTHER PUBLICATIONS

U.S. Appl. No. 29/812,621, inventor William C. Blezard, filed Oct. 22, 2021 (available in USPTO's IFW system).
U.S. Appl. No. 17/668,610, inventor William C. Blezard, filed Feb. 10, 2022 (available in USPTO's FW system).
U.S. Appl. No. 18/085,136, inventors James Nilsen et al., filed Dec. 20, 2022 (available in USPTO's FW system).
Oró et al., "Review on phase change materials (PCMs) for cold thermal energy storage applications," Applied Energy, 99:513-533 (2012).
U.S. Appl. No. 17/585,139, inventors James Nilsen et al., filed Jan. 26, 2022 (available in USPTO's FW system).
U.S. Appl. No. 16/246,435, inventors James Robert Chasteen et al., filed Jan. 11, 2019 (available in USPTO's IFW system).
U.S. Appl. No. 16/827,086, inventors Dawn E. Smith et al., filed Mar. 23, 2020 (available in USPTO's FW system).
U.S. Appl. No. 17/675,251, inventors Heather M. Conway et al. filed Feb. 18, 2022 (available in USPTO's IFW system).
U.S. Appl. No. 17/687,382, inventors James R. Chasteen et al., filed Mar. 4, 2022 (available in USPTO's IFW system).
U.S. Appl. No. 17/726,318, inventors Henry Melchor et al., filed Apr. 21, 2022 (available in USPTO's IFW system).
U.S. Appl. No. 17/700,149, inventors TzeHo Lee et al., filed Mar. 21, 2022 (available in USPTO's IFW system).
Pack-out Sheet for Excel GTS-6L-RFG Shipping System, Cold Chain Technologies, Franklin, MA (2014).
Pack-out Sheet for KoolTemp GTS Excel 26L Shipping System, Cold Chain Technologies, Franklin, MA (2013).
Pack-out Sheet for KoolTemp GTS Excel Lite 6L Shipping System, Cold Chain Technologies, Franklin, MA (2014).
Pack-out Sheet for GTS Excel Lite 12L Shipping System, Cold Chain Technologies, Franklin, MA (2015).
Pack-out Sheet for KoolTemp GTS Excel Lite 26L Shipping System, Cold Chain Technologies, Franklin, MA (2015).
Pack-out Sheet for KoolTemp GTS Excel Lite 52L Shipping System, Cold Chain Technologies, Franklin, MA (2015).
Pack-out Sheet for KoolTemp GTS Extreme 15L Shipping System, Cold Chain Technologies, Franklin, MA (2014).

* cited by examiner

PRODUCT BOX SUITABLE FOR RECEIVING TEMPERATURE-SENSITIVE MATERIALS AND SHIPPING SYSTEM INCLUDING THE SAME

CROSS-REFERENCE TO RELATED APPLICATIONS

The present application claims the benefit under 35 U.S.C. 119(e) of U.S. Provisional Patent Application No. 62/994,599, inventor Henry R. Melchor, filed Mar. 25, 2020, the disclosure of which is incorporated herein by reference.

BACKGROUND OF THE INVENTION

The present invention relates generally to methods and systems for maintaining temperature-sensitive materials within a desired temperature range for a period of time and relates more particularly to a novel product box for use in a shipping system for maintaining temperature-sensitive materials within a desired temperature range for a period of time.

There is a continuing need for systems that can maintain temperature-sensitive materials within a desired temperature range for an extended period of time. For example, many pharmaceuticals, biological materials, medical devices, foods, beverages, and other temperature-sensitive materials must be maintained within a particular temperature range (such as, for example, +2° C. to +8° C.) in order to prevent the spoilage of such materials. As can readily be appreciated, the maintenance of such materials within a desired temperature range while such materials are being transported and/or stored can be challenging. One way in which such temperature maintenance may be achieved is by transporting and/or storing such materials in active temperature-control devices, such as electrically-powered refrigeration units or the like. However, as can be appreciated, such active temperature-control devices add considerable expense to transportation and/or storage costs.

An alternative approach to temperature maintenance during transportation and/or storage is to place the temperature-sensitive materials within an insulated container that also contains one or more passive temperature-control members, such as, but not limited to, ice packs, gel packs, dry ice, wet ice, or the like. In some cases, such as in the case of an ice pack or a gel pack, the passive temperature-control member typically comprises a quantity of a phase-change material (PCM) disposed within a suitable casing or container. In other cases, such as in the case of dry ice or wet ice, the passive temperature-control member may be loose within the insulated container.

Often, the temperature-sensitive materials are housed within a product box (sometimes alternatively referred to as "a payload box") that, in turn, is housed within the insulated container. The product box, which is typically made of a corrugated cardboard or similar material, is typically shaped to have four equal sides, a top, and a bottom, thereby defining a uniform rectangular prismatic cavity. The product box typically serves to provide a barrier between the temperature-sensitive materials, which are placed within the product box, and the passive temperature-control member(s), which are placed outside of the product box but within the insulated container. In this manner, the product box helps to keep the temperature-sensitive materials from coming into direct contact with the passive temperature-control member(s) and, consequently, getting too cold. In addition, the product box helps to keep the temperature-sensitive materials from becoming wet as the passive temperature-control member(s) melt(s).

Documents that may be of interest may include the following, all of which are incorporated herein by reference: U.S. Pat. No. 10,077,389 B2, inventors Formato et al., which issued Sep. 18, 2018; U.S. Pat. No. 9,944,449 B2, inventors Wood et al., which issued Apr. 17, 2018; U.S. Pat. No. 9,598,622 B2, inventors Formato et al., which issued Mar. 21, 2017; U.S. Pat. No. 9,556,373 B2, inventors Formato et al., which issued Jan. 31, 2017; U.S. Pat. No. 9,429,350 B2, inventor Chapman, Jr., which issued Aug. 30, 2016; U.S. Pat. No. 9,366,469 B2, inventor Chapman, Jr., which issued Jun. 14, 2016; U.S. Pat. No. 9,180,998 B2, inventors Banks et al., which issued Nov. 10, 2015; U.S. Pat. No. 9,045,278 B2, inventors Mustafa et al., which issued Jun. 2, 2015; U.S. Pat. No. 8,938,986 B2, inventors Matta et al., which issued Jan. 27, 2015; U.S. Pat. No. 8,887,515 B2, inventor Patstone, which issued Nov. 18, 2014; U.S. Pat. No. 8,613,202 B2, inventor Williams, which issued Dec. 24, 2013; U.S. Pat. No. 8,607,581 B2, inventors Williams et al., which issued Dec. 17, 2013; U.S. Pat. No. 8,250,882 B2, inventors Mustafa et al., which issued Aug. 28, 2012; U.S. Pat. No. 8,074,465 B2, inventors Heroux et al., which issued Dec. 13, 2011; U.S. Pat. No. 7,849,708 B2, inventor Goncharko et al., which issued Dec. 14, 2010; U.S. Pat. No. 7,257,963 B2, inventor Mayer, which issued Aug. 21, 2007; U.S. Pat. No. 6,875,486 B2, inventor Miller, which issued Apr. 5, 2005; U.S. Pat. No. 6,868,982 B2, inventor Gordon, which issued Mar. 22, 2005; U.S. Pat. No. 6,482,332 B1, inventor Malach, which issued Nov. 19, 2002; U.S. Pat. No. 6,116,042, inventor Purdum, which issued Sep. 12, 2000; U.S. Pat. No. 5,924,302, inventor Derifield, which issued Jul. 20, 1999; U.S. Pat. No. 5,899,088, inventor Purdum, which issued May 4, 1999; U.S. Patent Application Publication No. US 2021/0024270 A1, inventor Mirzaee Kakhki, which published Jan. 28, 2021; U.S. Patent Application Publication No. US 2020/0408453 A1, inventor Martino, which published Dec. 31, 2020; U.S. Patent Application Publication No. 2020/0231362 A1, inventors Kulangara et al., which published Jul. 23, 2020; U.S. Patent Application Publication No. US 2020/0002075, inventors Lee et al., which published Jan. 2, 2020; U.S. Patent Application Publication No. 2019/0210790 A1, inventors Rizzo et al., which published Jul. 11, 2019; U.S. Patent Application No. US 2018/0328644 A1, inventors Rizzo et al., which published Nov. 15, 2018; U.S. Patent Application Publication No. US 2018/0320947 A1, inventors Jain et al., which published Nov. 8, 2018; U.S. Patent Application Publication No. US 2018/0100682 A1, inventors Nilsen et al., which published Apr. 12, 2018; U.S. Patent Application Publication No. US 2018/0093816 A1, inventors Longley et al., which published Apr. 5, 2018; U.S. Patent Application Publication No. US 2017/0121097 A1, inventors Pranadi et al., which published May 4, 2017; U.S. Patent Application Publication No. US 2016/0362240 A1, inventors Ferracamo, Jr., which published Dec. 15, 2016; U.S. Patent Application Publication No. US 2011/0290792 A1, inventors Krzak et al., which published Dec. 1, 2011; PCT International Publication No. WO 2018/213348 A2, which published Nov. 22, 2018; and Oró et al., "Review on phase change materials (PCMs) for cold thermal energy storage applications," Applied Energy, 99:513-533 (2012).

SUMMARY OF THE INVENTION

It is an object of the present invention to provide a novel product box suitable for receiving temperature-sensitive materials.

According to one aspect of the invention, there is provided a product box, the product box comprising (a) a front, the front comprising an upper edge and a lower edge; (b) a rear, the rear comprising an upper edge and a lower edge; (c) a left side, the left side comprising an upper edge and a lower edge; (d) a right side, the right side comprising an upper edge and a lower edge, wherein the upper edges of the front and the rear are higher than the upper edges of the left side and the right side and/or the lower edges of the front and the rear are lower than the lower edges of the left side and the right side; (e) a first set of closable flaps, the first set of closable flaps including a first flap, a second flap, a third flap, and a fourth flap, wherein the first flap is hingedly connected to the front, the second flap is hingedly connected to the rear, the third flap is hingedly connected to the left side, and the fourth flap is hingedly connected to the right side, wherein the first flap, the second flap, the third flap, and the fourth flap are disposed at the upper edges of the front, the rear, the left side and the right side, respectively, or at the lower edges of the front, the rear, the left side, and the right side, respectively, and wherein, when the first, second, third and fourth flaps are closed, a first air gap is formed between the first and second flaps and the third and fourth flaps.

In a more detailed feature of the invention, the first air gap may have a height of about 1 inch.

In a more detailed feature of the invention, the first flap, the second flap, the third flap, and the fourth flap may be disposed at the upper edges of the front, the rear, the left side and the right side, respectively.

In a more detailed feature of the invention, the first flap, the second flap, the third flap, and the fourth flap may be disposed at the lower edges of the front, the rear, the left side and the right side, respectively.

In a more detailed feature of the invention, the product box may further comprise a second set of closable flaps, the second set of closable flaps may include a first flap, a second flap, a third flap, and a fourth flap, the first flap of the second set of closable flaps may be hingedly connected to the front, the second flap of the second set of closable flaps may be hingedly connected to the rear, the third flap of the second set of closable flaps may be hingedly connected to the left side, the fourth flap of the second set of closable flaps may hingedly connected to the right side, the first flap of the second set of closable flaps, the second flap of the second set of closable flaps, the third flap of the second set of closable flaps, and the fourth flap of the second set of closable flaps may be disposed at the upper edges of the front, the rear, the left side and the right side, respectively, and, when the first, second, third and fourth flaps of the second set of closable flaps are closed, a second air gap may be formed between the first and second flaps of the second set of closable flaps and the third and fourth flaps of the second set of closable flaps.

In a more detailed feature of the invention, the second air gap may have a height of about 1 inch.

In a more detailed feature of the invention, the front, the rear, the left side, the right side, the first set of closable flaps, and the second set of closable flaps may be formed from a one-piece blank.

In a more detailed feature of the invention, the product box may be made of cardboard.

According to another aspect of the invention, there is provided a product box, the product box comprising (a) a first pair of opposing sides, wherein each side of the first pair of opposing sides includes a top and a bottom; (b) a second pair of opposing sides, wherein each side of the second pair of opposing sides includes a top and a bottom and wherein the tops of the sides of the first pair of opposing sides are higher than the tops of the sides of the second pair of opposing sides; (c) an inner top cover, wherein the inner top cover is aligned with the tops of the sides of the second pair of opposing sides; and (d) an outer top cover, wherein the outer top cover is aligned with the tops of the sides of the first pair of opposing sides; (e) wherein an air gap is formed between the inner top cover and the outer top cover.

In a more detailed feature of the invention, the air gap may have a height of about 1 inch.

In a more detailed feature of the invention, the first pair of opposing sides may include a front and a rear, and the second pair of opposing sides may include a left side and a right side.

In a more detailed feature of the invention, the inner top cover may comprise a first closure flap hingedly connected to one of the second pair of opposing sides and a second closure flap hingedly connected to another of the second pair of opposing sides.

In a more detailed feature of the invention, the outer top cover may comprise a first closure flap hingedly connected to one of the first pair of opposing sides and a second closure flap hingedly connected to another of the first pair of opposing sides.

In a more detailed feature of the invention, the product box may further comprise a plurality of bottom closure flaps.

According to still another aspect of the invention, there is provided a product box, the product box comprising (a) a first pair of opposing sides, wherein each side of the first pair of opposing sides includes a top and a bottom; (b) a second pair of opposing sides, wherein each side of the second pair of opposing sides includes a top and a bottom and wherein the bottoms of the sides of the first pair of opposing sides are lower than the bottoms of the sides of the second pair of opposing sides; (c) an inner bottom cover, wherein the inner bottom cover is aligned with the bottoms of the sides of the second pair of opposing sides; and (d) an outer bottom cover, wherein the outer bottom cover is aligned with the bottoms of the sides of the first pair of opposing sides; (e) wherein an air gap is formed between the inner bottom cover and the outer bottom cover.

In a more detailed feature of the invention, the air gap may have a height of about 1 inch. In a more detailed feature of the invention, the first pair of opposing sides may include a front and a rear, and the second pair of opposing sides may include a left side and a right side.

In a more detailed feature of the invention, the inner bottom cover may comprise a first closure flap hingedly connected to one of the second pair of opposing sides and a second closure flap hingedly connected to another of the second pair of opposing sides.

In a more detailed feature of the invention, the outer bottom cover may comprise a first closure flap hingedly connected to one of the first pair of opposing sides and a second closure flap hingedly connected to another of the first pair of opposing sides.

In a more detailed feature of the invention, the product box may further comprise a plurality of top closure flaps.

According to a further aspect of the invention, there is provided a product box, the product box comprising (a) a front, the front comprising an upper edge and a lower edge; (b) a rear, the rear comprising an upper edge and a lower edge; (c) a left side, the left side comprising an upper edge and a lower edge; (d) a right side, the right side comprising an upper edge and a lower edge; (e) a bottom; and (f) a set of wings, the set of wings including a first wing, a second wing, a third wing, and a fourth wing, wherein the first wing extends outwardly from the front proximate to the upper edge thereof, the second wing extends outwardly from the rear proximate to the upper edge thereof, the third wing extends outwardly from the left side proximate to the upper edge thereof, and the fourth wing extends outwardly from the right side proximate to the upper edge thereof.

In a more detailed feature of the invention, the upper edges of the front and the rear may be higher than the upper edges of the left side and the right side, and the product box may further comprise a first closure flap hingedly connected to the upper edge of the front, a second closure flap hingedly connected to the upper edge of the rear, a third closure flap hingedly connected to the upper edge of the left side, and a fourth closure flap hingedly connected to the upper edge of the right side, and, when the first, second, third and fourth closure flaps are closed, an air gap may be formed between the first and second closure flaps and the third and fourth closure flaps.

In a more detailed feature of the invention, the product box may further comprise a first closure flap hingedly connected to the upper edge of the front, a second closure flap hingedly connected to the upper edge of the rear, a third closure flap hingedly connected to the upper edge of the left side, and a fourth closure flap hingedly connected to the upper edge of the right side.

It is another object of the present invention to provide a novel shipping system suitable for use in transporting and/or storing temperature-sensitive materials for a period of time, wherein the shipping system includes the aforementioned product box, as well as an insulated container and one or more phase-change material packages.

For example, in one embodiment, the shipping system may comprise (a) an insulated container; (b) the product box as described above, the product box disposed within the insulated container; and (c) at least one phase-change material package disposed within the insulated container, the at least one phase-change material package placed in contact with the first and/or second flap and spaced away from the third and fourth flaps by the air gap.

According to another exemplary embodiment, the shipping system may comprise (a) an insulated container; (b) the product box as described above, the product box disposed within the insulated container; and (c) at least one phase-change material package disposed within the insulated container, the at least one phase-change material package placed directly on top of the product box.

The present invention is also directed to a kit comprising an insulated container, a product box, and one or more phase-change material packages (e.g., gel packs, ice packs, or the like) that may be assembled in one or more alternative configurations.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numerals represent like parts.

DETAILED DESCRIPTION OF THE INVENTION

Figure 1A:
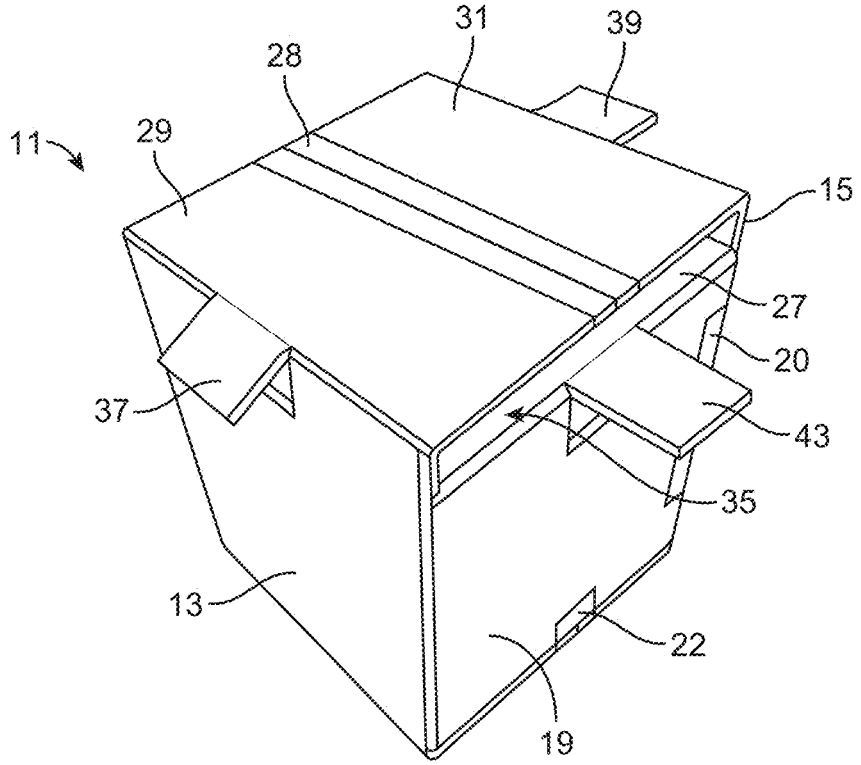
FIGS. 1A through 1D are perspective views of a first embodiment of a product box constructed according to the teachings of the present invention, with FIGS. 1A and 1B showing the product box in an upright position, with FIG. 1C showing one of the lower flaps of the product box partially open, and with FIG. 1D showing the product box in an inverted position.
Figure 1B:
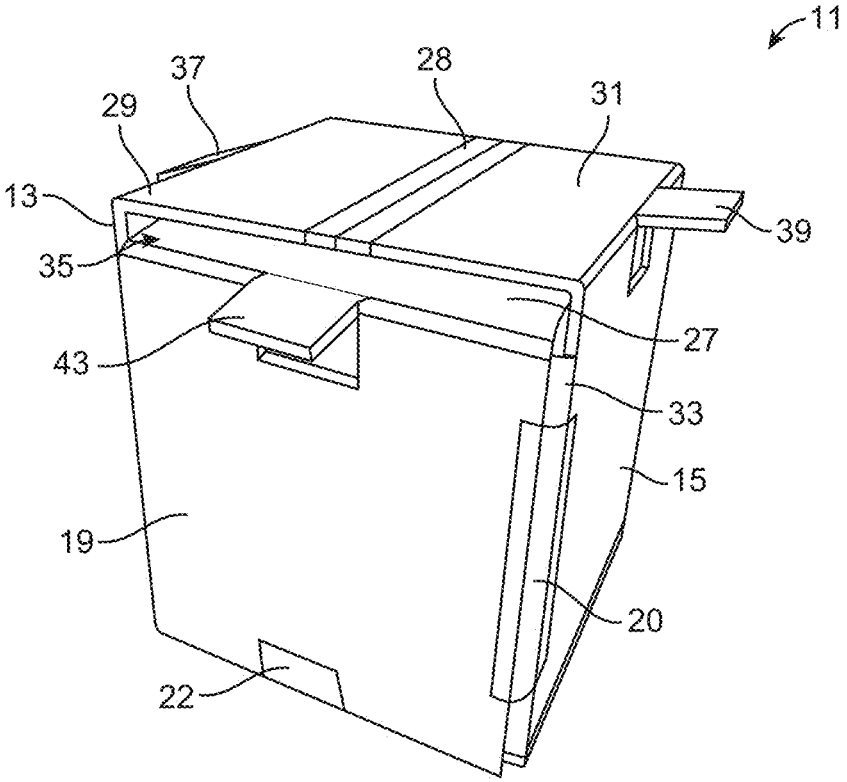
Figure 1C:
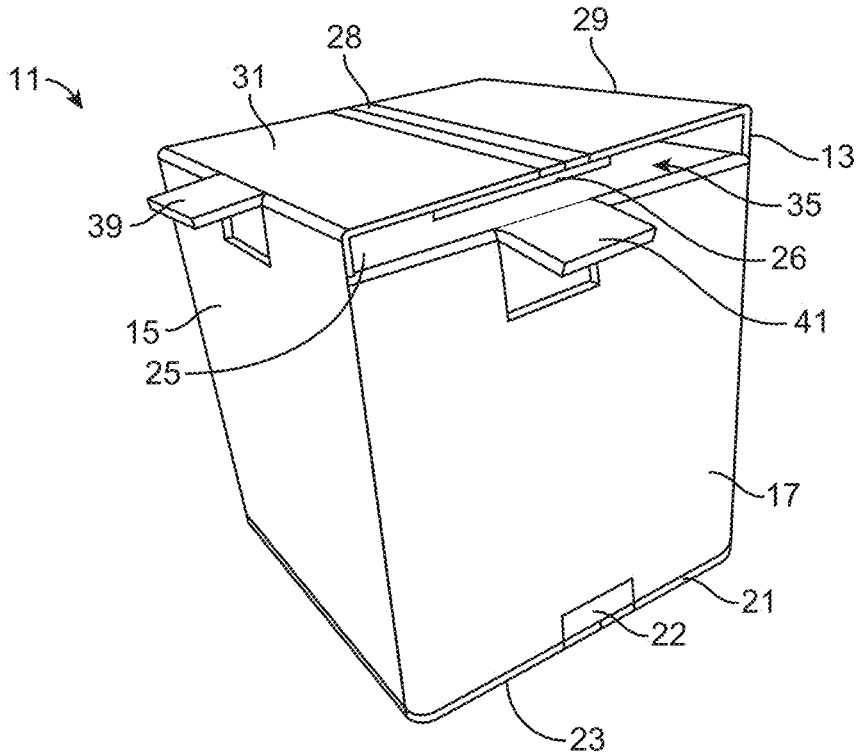
Figure 1D:
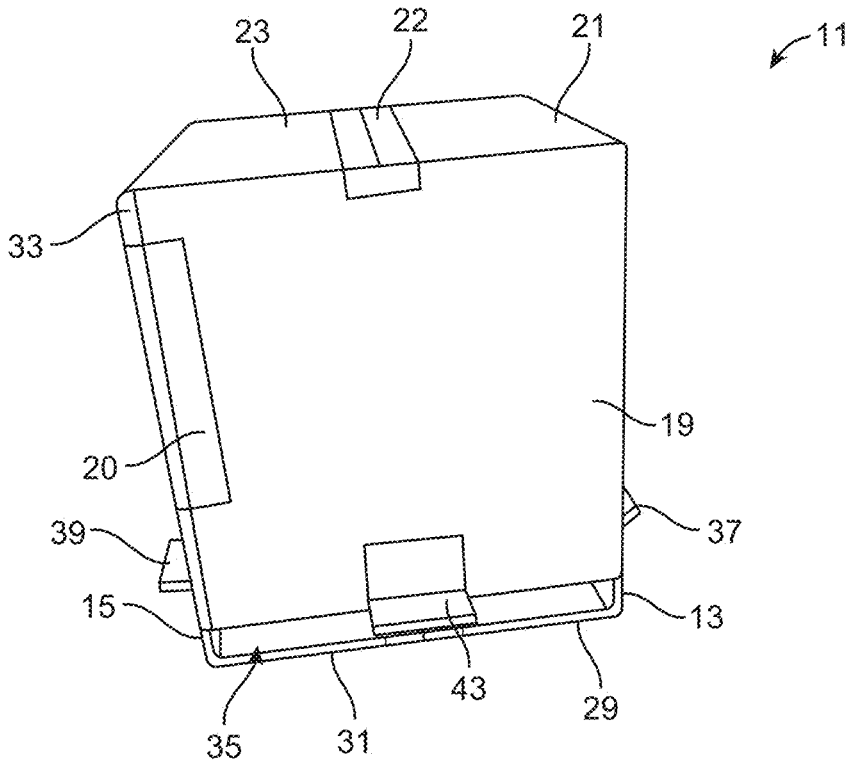
Figure 2A:
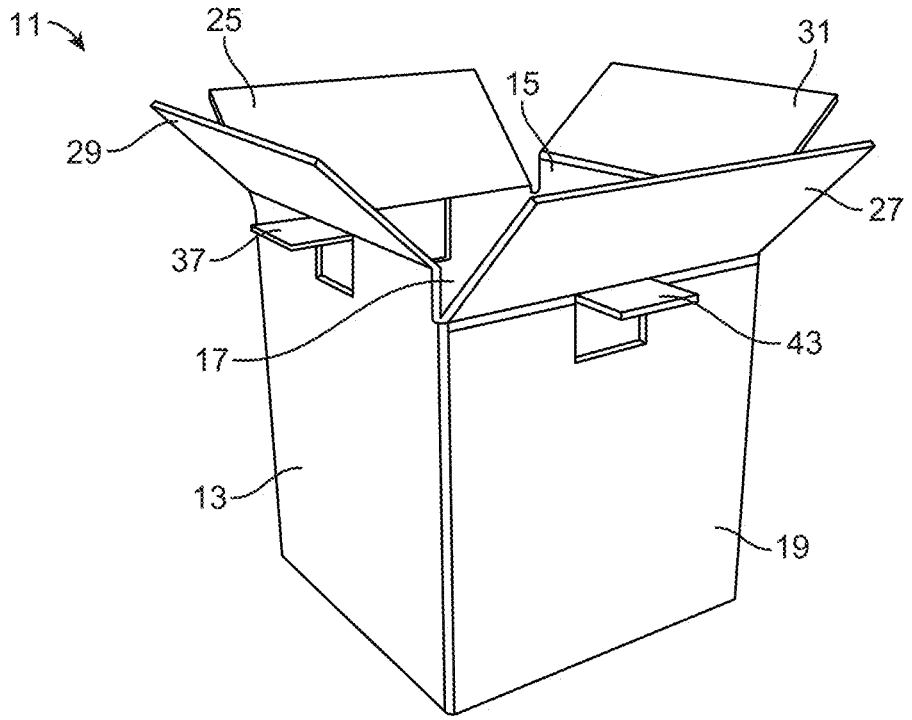
FIG. 2A is a perspective view of the product box of FIG. 1A, with the upper flaps of the product box shown in an open state.
Figure 2B:
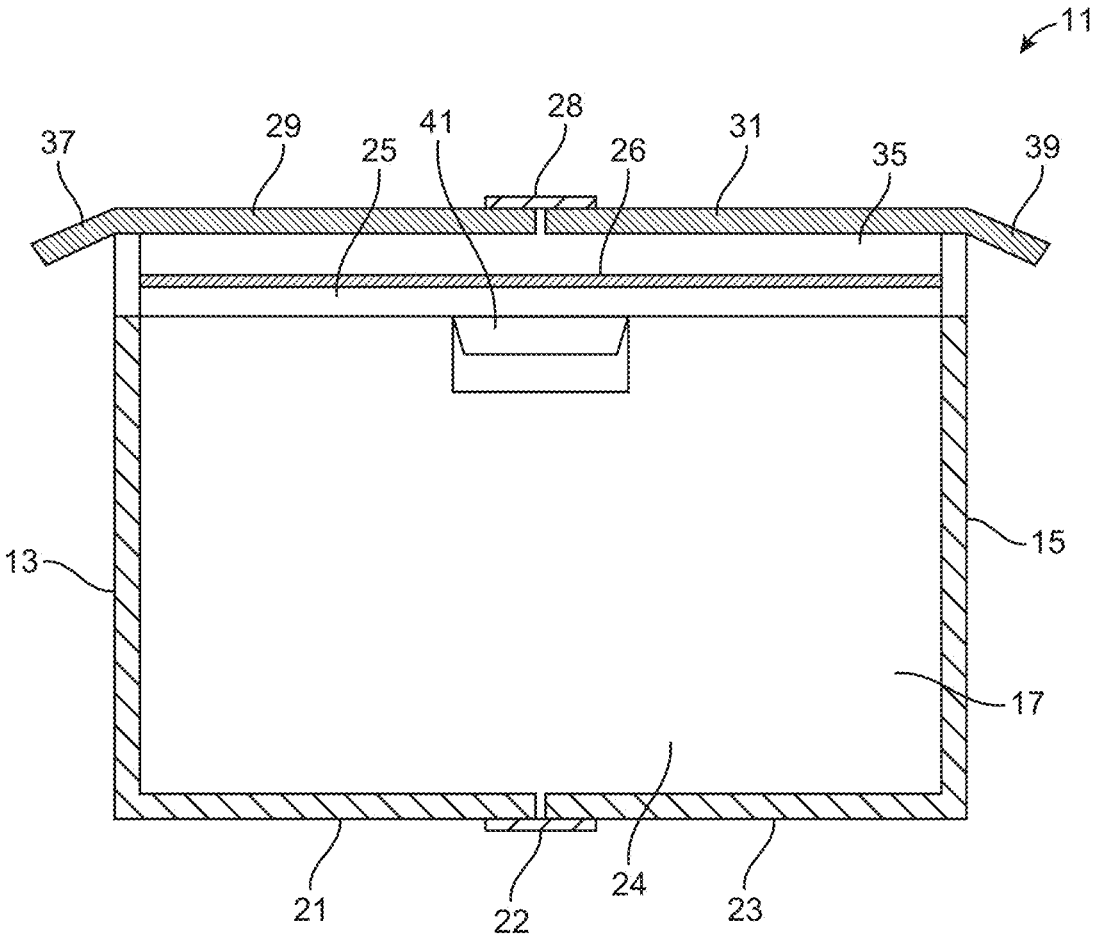
FIG. 2B is a section view of the product box of FIG. 1A.

Referring now to FIGS. 1A-1D and 2A-2B, there are shown various views of a first embodiment of a product box constructed according to the teachings of the present invention, the product box being represented generally by reference numeral 11. Details of product box 11 that are discussed elsewhere in this application or that are not critical to an understanding of the invention may be omitted from one or more of FIGS. 1A-1D and 2A-2B and/or from the accompanying description herein or may be shown in one or more of FIGS. 1A-1D and 2A-2B and/or described herein in a simplified manner.

Product box 11 may comprise a front 13, a rear 15, a left side 17, a right side 19, a plurality of lower flaps 21 and 23, a first plurality of upper flaps 25 and 27, and a second plurality of upper flaps 29 and 31.

Front 13 and rear 15 may extend generally vertically and parallel to one another and may have substantially matching lengths and widths. Left side 17 and right side 19 may extend generally vertically and parallel to one another and may have substantially matching lengths and widths. Each of left side 17 and right side 19 may be generally perpendicular to each of front 13 and rear 15. The lengths (i.e., heights) of front 13 and rear 15 may be greater than the lengths (i.e., heights) of left side 17 and right side 19. For example, each of front 13 and rear 15 may have a length that is approximately 1 inch greater than the length of each of left side 17 and right side 19. The lower edges of front 13, rear 15, left side 17, and right side 19 may be substantially aligned with one another. As a result, the upper edges of front 13 and rear 15 may extend upwardly beyond the upper edges of left side 17 and right side 19 to create an air gap of about 1 inch.

Front 13 may be integrally connected along its left vertical edge to left side 17 and may be integrally connected along its right vertical edge to right side 19. Rear 15 may be integrally connected along one vertical edge to left side 17 and may be joined to right side 19 using a panel 33. More specifically, panel 33 may be integrally connected along one vertical edge to rear 15 and may have its outer face secured to the inner face of right side 19 using an adhesive tape 20 or other suitable means. (In the present embodiment, tape 20 is shown as transparent but need not be.)

Lower flap 21 may be integrally connected along its front edge to the lower edge of front 13 and may extend generally perpendicularly relative to front 13 (i.e., generally horizontally). Lower flap 23 may be integrally connected along its rear edge to the lower edge of rear 15 and may extend generally perpendicularly relative to rear 15 (i.e., generally horizontally). The rear edge of lower flap 21 and the front edge of lower flap 23 may be secured to one another using an adhesive tape 22 or other suitable means. (In the present embodiment, tape 22 is shown as transparent but need not be.) When secured to one another, flaps 21 and 23 may define the lower boundary of an interior cavity 24 of product box 11, and flaps 21 and 23 may substantially close interior cavity 24 of product box 11 at its lower end.

Upper flap 25 may be integrally connected along its left edge to the upper edge of left side 17 and may extend generally perpendicularly relative to left side 17 (i.e., generally horizontally). Upper flap 27 may be integrally connected along its right edge to the upper edge of right side 19 and may extend generally perpendicularly relative to right side 19 (i.e., generally horizontally). The right edge of upper flap 25 and the left edge of upper flap 27 may be secured to one another using adhesive tape 26 or other suitable means. (In the present embodiment, tape 26 is shown as transparent but need not be.) When secured to one another, flaps 25 and 27 may define the upper boundary of interior cavity 24 of product box 11, and flaps 25 and 27 may substantially close interior cavity 24 of product box 11 at its upper end. As can be seen, in the present embodiment, interior cavity 24 may be a generally rectangular prismatic cavity but need not be.

Upper flap 29 may be integrally connected along its front edge to the upper edge of front 13 and may extend generally perpendicularly relative to front 13 (i.e., generally horizontally), and upper flap 31 may be integrally connected along its rear edge to the upper edge of rear 15 and may extend generally perpendicularly relative to rear 15 (i.e., generally horizontally). The rear edge of upper flap 29 and the front edge of upper flap 31 may be secured to one another using adhesive tape 28 or other suitable means. (In the present embodiment, tape 28 is shown as transparent but need not be.) Due, at least in part, to the fact that the upper edges of front 13 and rear 15 extend above the upper edges of left side 17 and right side 19 when upper flaps 29 and 31 are secured to one another, a space 35 may be formed above flaps 25 and 27 and below flaps 29 and 31. Space 35, which may be filled with or contain air, may serve to thermally insulate, to a certain extent, items in interior cavity 24 of product box 11 from a passive temperature-control member positioned on top of flaps 29 and 31. This may be advantageous, for example, in circumstances in which the passive temperature-control member, if sitting directly on top of a conventional product box, would cause the contents of the product box to become too cold. Consequently, such an approach may obviate the need to position materials, like bubble wrap, between the top of the product box and the passive temperature-control member to keep the contents of the product box from becoming too cold.

Product box 11 may further comprise a plurality of tabs or wings, a first wing 37 integrally connected to flap 29 and extending outwardly at the interface of front 13 and flap 29, a second wing 39 integrally connected to flap 31 and extending outwardly at the interface of rear 15 and flap 31, a third wing 41 integrally connected to flap 25 and extending outwardly at the interface of left side 17 and flap 25, and a fourth wing 43 integrally connected to flap 27 and extending outwardly at the interface of right side 19 and flap 27. Wings 37, 39, 41 and 43, which may be cut out from front 13, rear 15, left side 17, and right side 19, respectively, may be appropriately dimensioned to engage the inside surfaces of the front, rear, and side walls of an insulated container into which product box 11 may be positioned and, in so doing, may space front 13, rear 15, left side 17, and right side 19 from the aforementioned walls of the insulated container. This may allow air to circulate around product box 11, thereby minimizing temperature gradients around product box 11. According to one embodiment, wings 37, 39, 41 and 43 may be dimensioned to one another. In this manner, product box 11 may be generally centered relative to the vertical walls of the insulated container by wings 37, 39, 41 and 43.

Figure 3:
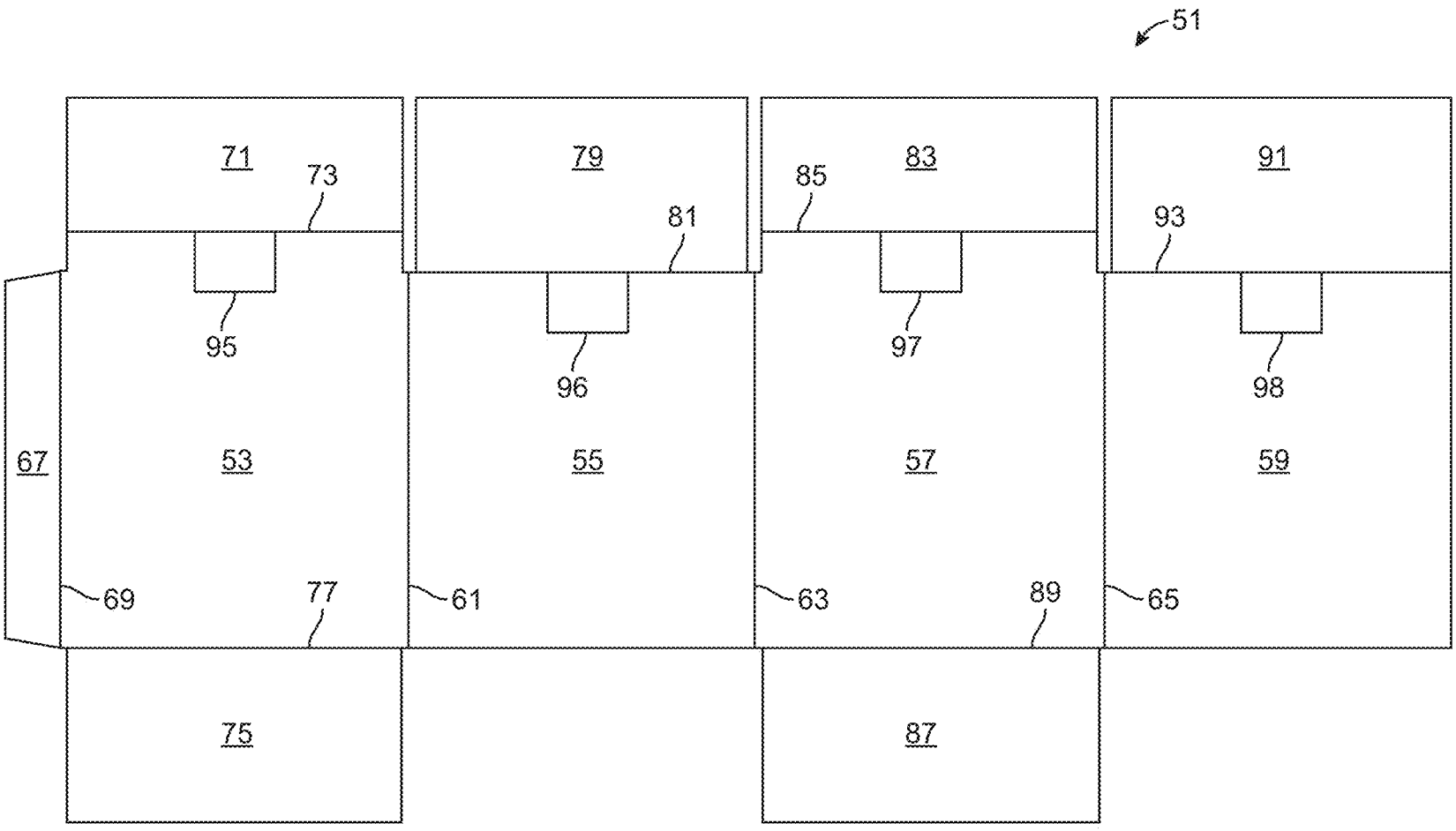
FIG. 3 is a top view of a blank that may be used to form the product box of FIG. 1A.
Figure 4A:
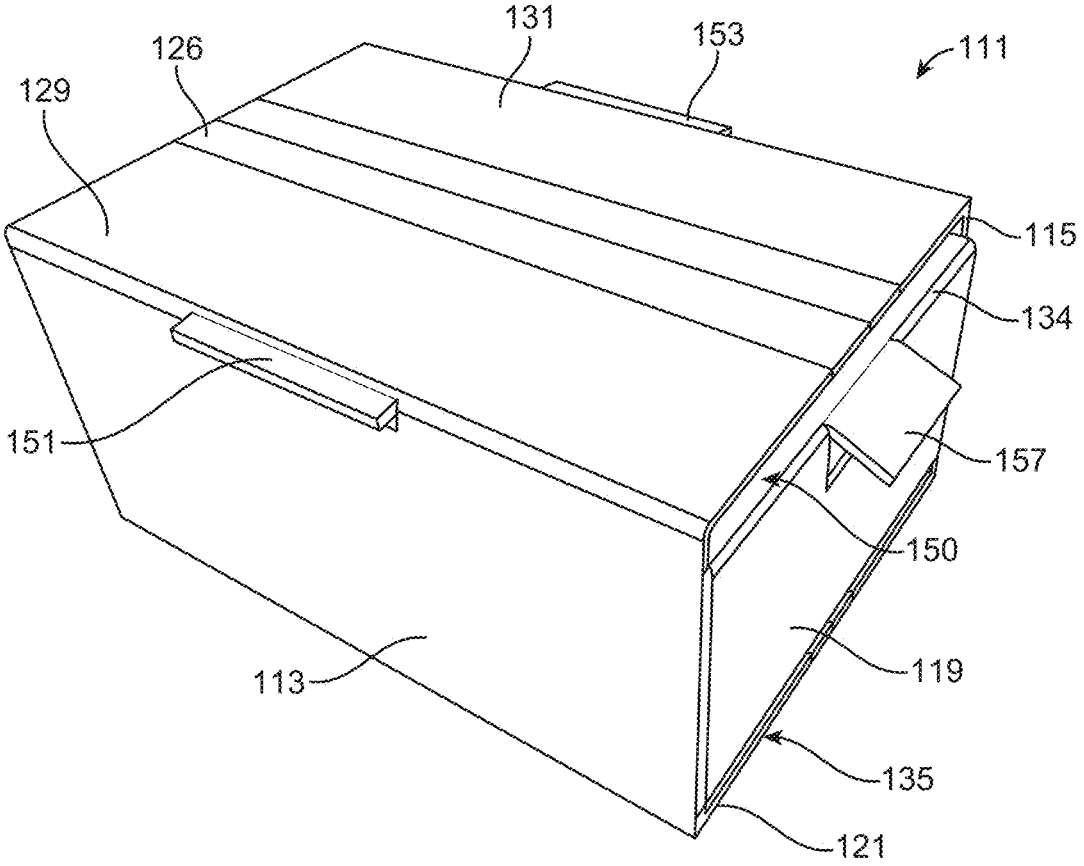
FIGS. 4A through 4D perspective views of a second embodiment of a product box constructed according to the teachings of the present invention, with FIGS. 4A and 4B showing the product box in an upright position and with FIGS. 4C and 4D showing the product box in an inverted position.
Figure 4B:
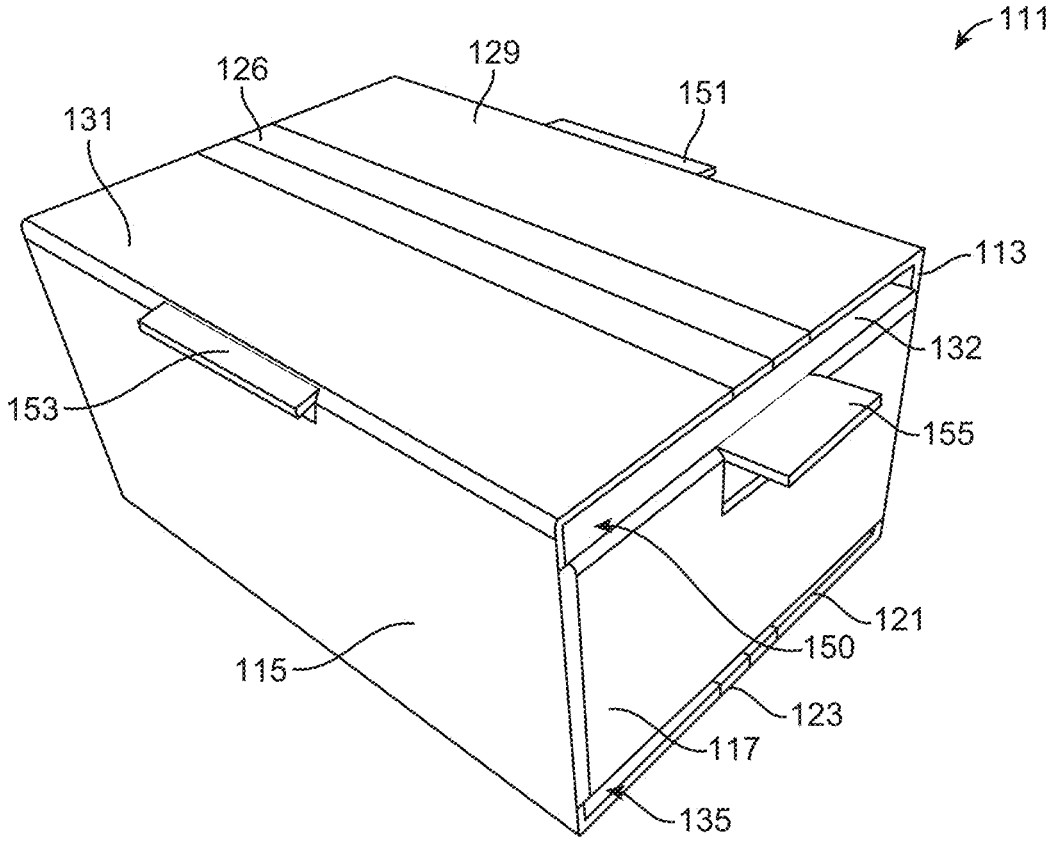
Figure 4C:
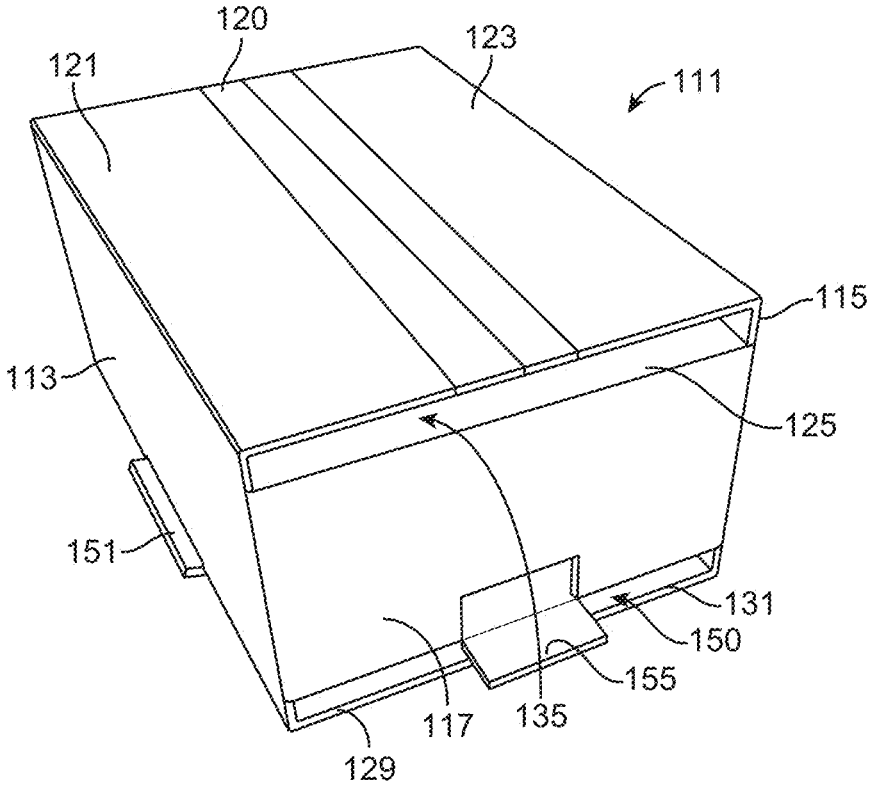
Figure 4D:
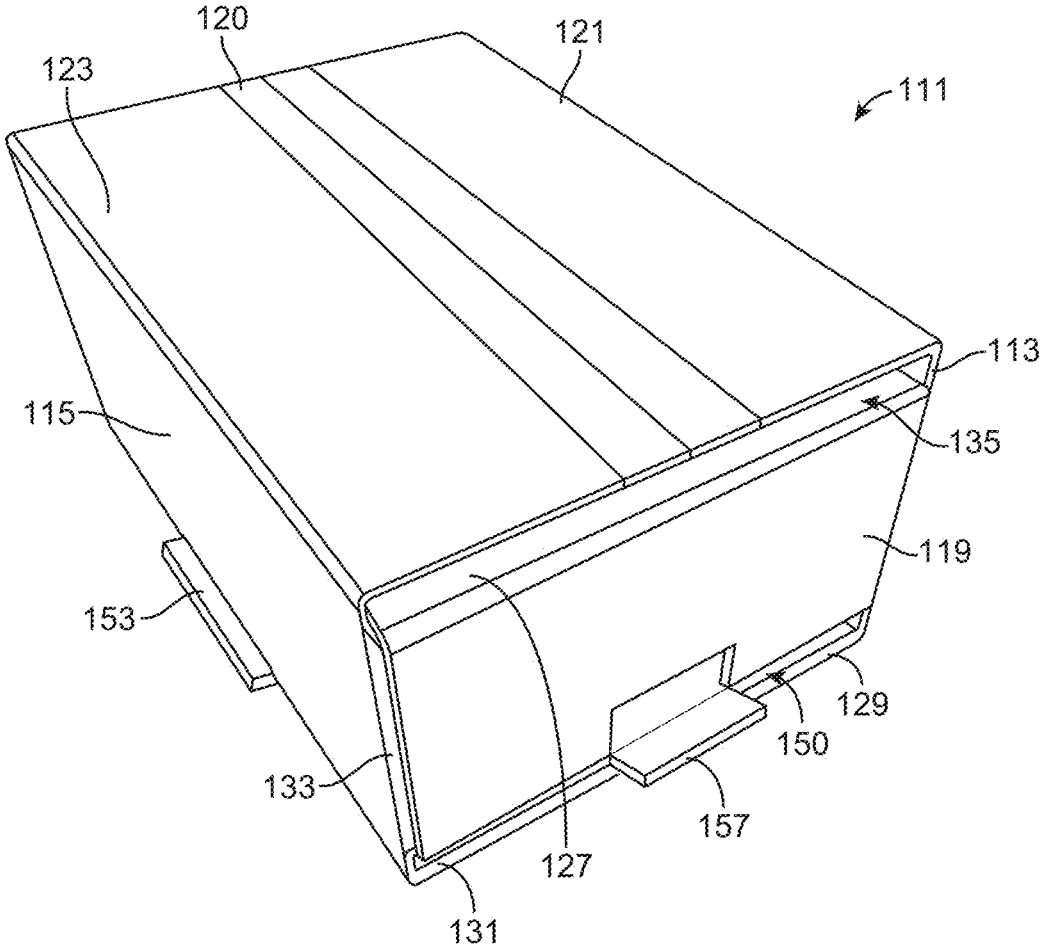
Figure 5A:
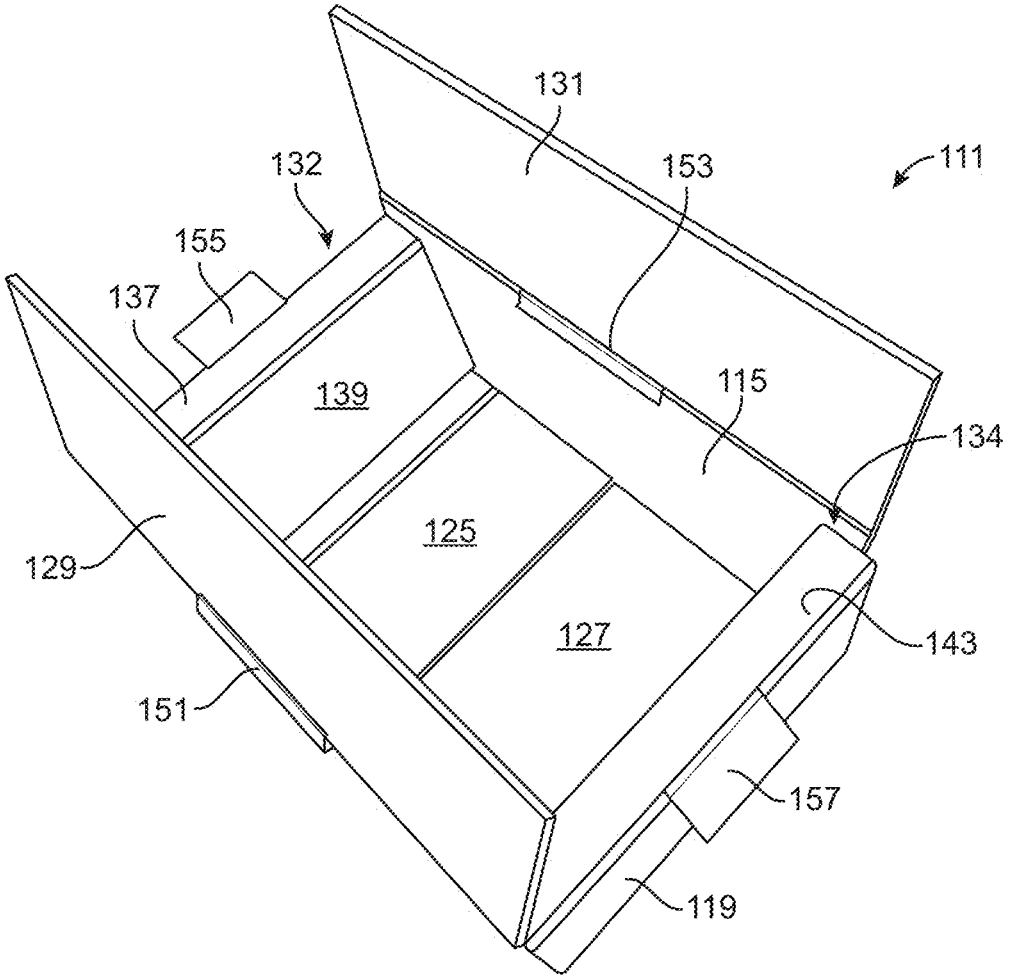
FIGS. 5A and 5B are perspective views of the product box shown in FIG. 4A, with the upper flaps of the product box shown in an open state.
Figure 5B:
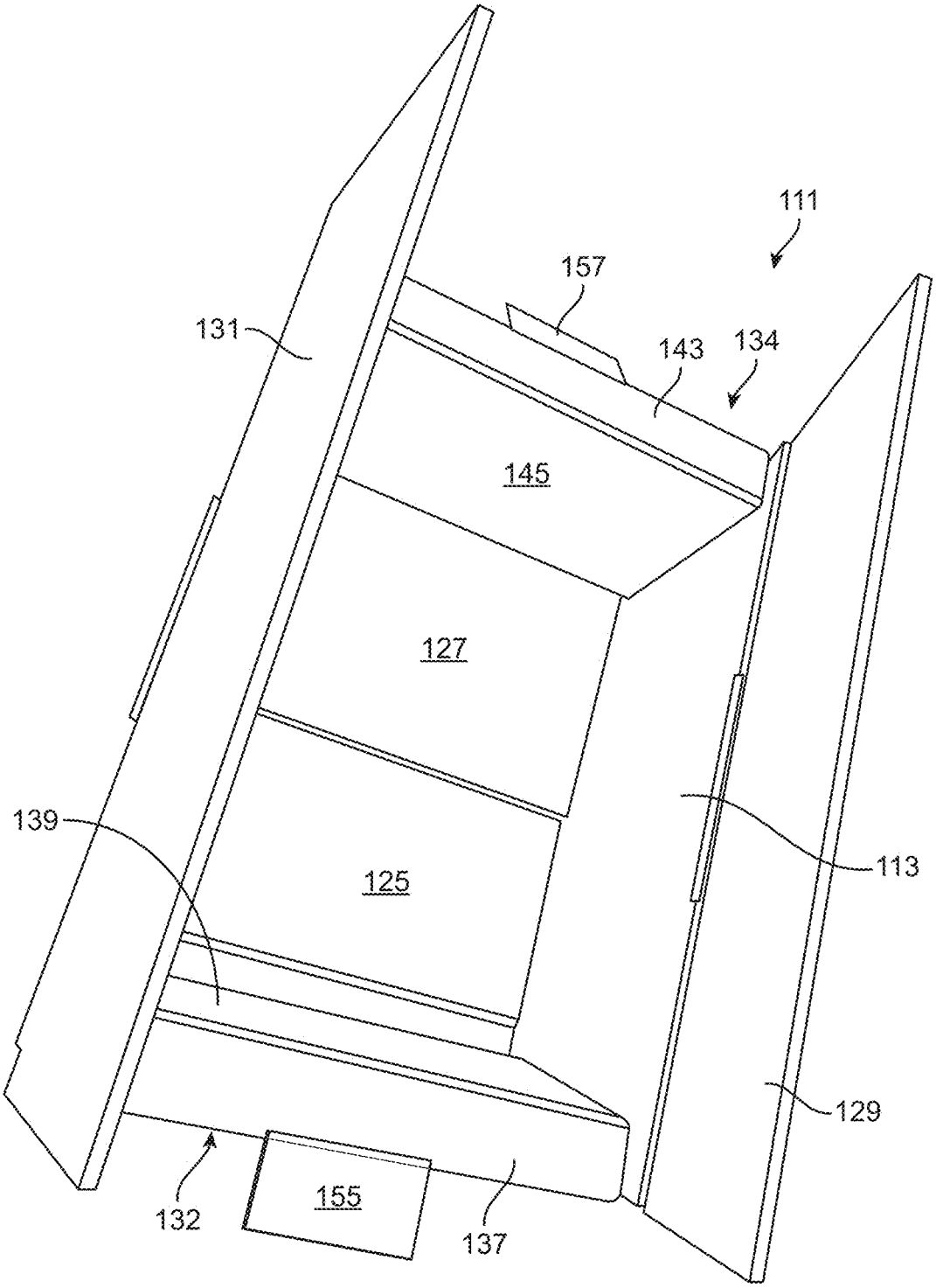
Figure 6:
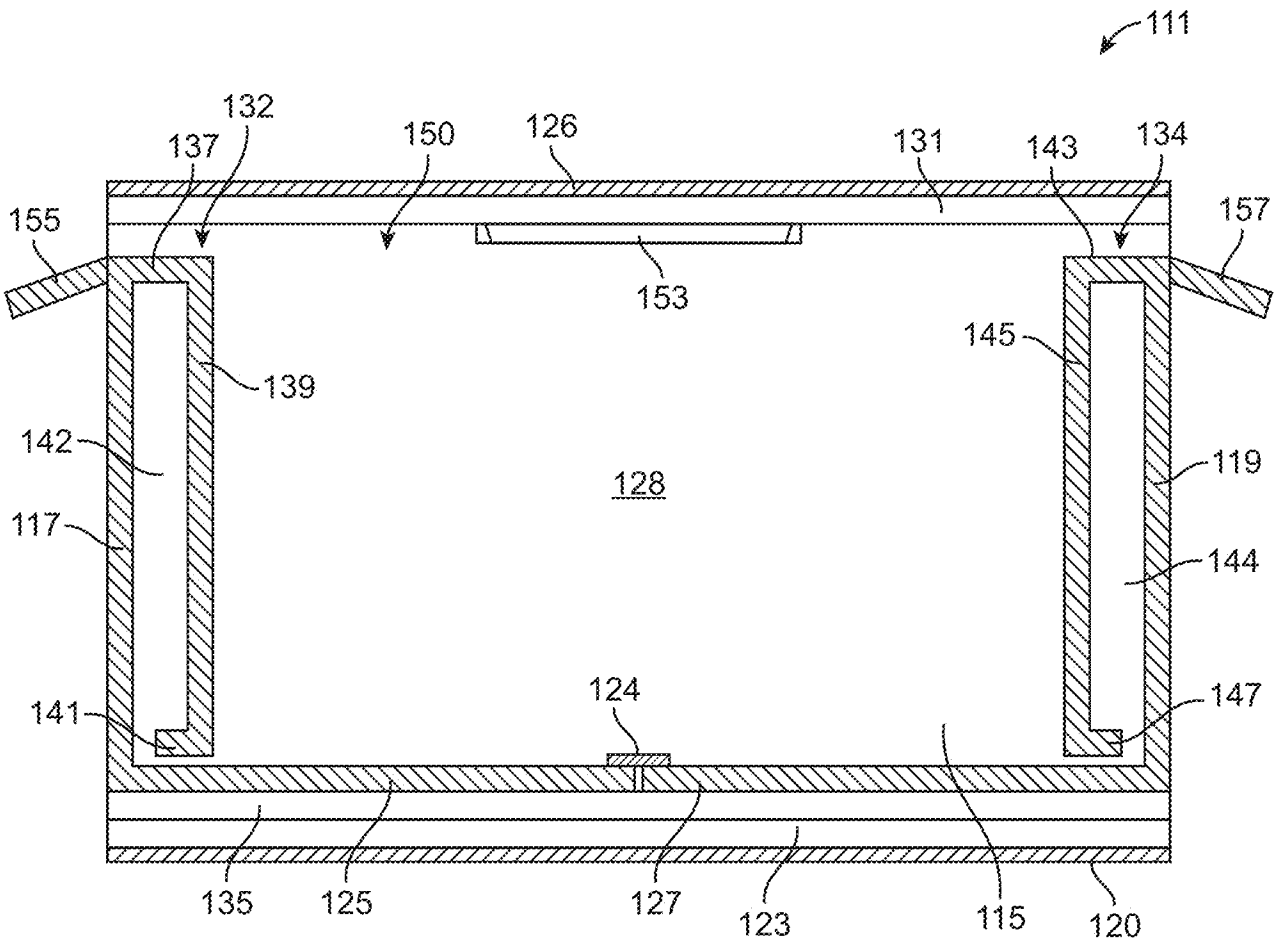
FIG. 6 is a section view of the product box shown in FIG. 4A.

Referring now to FIG. 3, there is shown a top view of a blank that may be used to form product box 11, the blank being constructed according to teachings of the present invention and being represented generally by reference numeral 51. Details of blank 51 that are discussed elsewhere in this application or that are not critical to an understanding of the invention may be omitted from FIG. 3 and/or from the accompanying description herein or may be shown in FIG. 3 and/or described herein in a simplified manner.

Blank 51, which may be a one-piece structure made of corrugated cardboard or a similar material, may be shaped to include a first panel 53, a second panel 55, a third panel 57, and a fourth panel 59. First panel 53 may be hingedly connected along a right side thereof to second panel 55 by a first score line 61, second panel 55 may be hingedly connected along a right side thereof to third panel 57 by a second score line 63, and third panel 57 may be hingedly connected along a right side thereof to fourth panel 59 by a third score line 65. In this manner, first panel 53 may be used to form rear 15, second panel 55 may be used to form left side 17, third panel 57 may be used to form front 13, and fourth panel 55 may be used to form right side 19.

First panel 53 may be hingedly connected along a left side thereof to a fifth panel 67 by a fourth score line 69. In addition, first panel 53 may be hingedly connected along a top edge thereof to a sixth panel 71 by a fifth score line 73, and first panel 53 may be hingedly connected along a bottom edge thereof to a seventh panel 75 by a sixth score line 77. Fifth panel 67 may be used to form panel 33, sixth panel 71 may be used to form upper flap 31, and seventh panel 75 may be used to form lower flap 23.

Second panel 55 may be hingedly connected along a top edge thereof to an eighth panel 79 by a seventh score line 81. Eighth panel 79 may be used to form flap 25.

Third panel 57 may be hingedly connected along a top edge thereof to a ninth panel 83 by an eighth score line 85. In addition, third panel 57 may be hingedly connected along a bottom edge thereof to a tenth panel 87 by a ninth score line 89. Ninth panel 83 may be used to form flap 29, and tenth panel 87 may be used to form lower flap 21.

Fourth panel 59 may be hingedly connected along a top edge thereof to an eleventh panel 91 by a tenth score line 93. Eleventh panel 91 may be used to form flap 27.

A first U-shaped cut 95 may be provided in first panel 53, first U-shaped cut 95 being used to form wing 39. A second U-shaped cut 96 may be provided in second panel 55, second U-shaped cut 96 being used to form wing 41. A third U-shaped cut 97 may be provided in third panel 57, third U-shaped cut 97 being used to form wing 37. A fourth U-shaped cut 98 may be provided in fourth panel 59, fourth U-shaped cut 98 being used to form wing 43.

Blank 51 may be appropriately dimensioned to make a product box having inner dimensions of 85/8 inches (length)×81/2 inches (width)×9 inches (depth). It is to be understood that these dimensions are merely exemplary.

Product box 11 may be used as a part of many different types of shipping systems and may be used to keep payloads within various target temperature ranges, such as, but not limited to, −20° C.+5° C. (frozen), +5° C.+3° C. (refrigerated), and +20° C.+5° C. (room temperature). For example, product box 11 may be disposed within the cavity of an insulated container (which may be made of, for example, expanded polystyrene or the like), which, in turn, may be disposed within an outer container made of, for example, corrugated cardboard or the like. One or more passive temperature-control members may also be positioned within the insulated container in contact with (or near) one or more outer surfaces of product box 11.

Referring now to FIGS. 4A-4D, 5A-5B, and 6, there are shown various views of a second embodiment of a product box constructed according to the teachings of the present invention, the product box being represented generally by reference numeral 111. Details of product box 111 that are discussed elsewhere in this application or that are not critical to an understanding of the invention may be omitted from one or more of FIGS. 4A-4D, 5A-5B and 6 and/or from the accompanying description herein or may be shown in one or more of FIGS. 4A-4D, 5A-5B and 6 and/or described herein in a simplified manner.

Product box 111 may comprise a front 113, a rear 115, a left side 117, a right side 119, a first plurality of lower flaps 121 and 123, a second plurality of lower flaps 125 and 127, a first plurality of upper flaps 129 and 131, and a second plurality of upper flaps 132 and 134.

Front 113 and rear 115 may extend generally vertically and parallel to one another and may have substantially matching lengths and widths. Left side 117 and right side 119 may extend generally vertically and parallel to one another and may have substantially matching lengths and widths. Each of left side 117 and right side 119 may be generally perpendicular to each of front 113 and rear 115. The widths (i.e., heights) of front 113 and rear 115 may be greater than the widths (i.e., heights) of left side 117 and right side 119. For example, each of front 113 and rear 115 may have a width that is approximately 2 inches greater than the width of each of left side 117 and right side 119. The upper and lower edges of front 113 and rear 115 may be substantially aligned with one another, and the upper and lower edges of left side 117 and right side 119 may be substantially aligned with one another, with left side 117 and right side 119 having their respective upper and lower edges substantially equidistantly spaced from the respective upper and lower edges of front 113 and rear 115. In other words, the lower edges of front 113 and rear 115 may be spaced downwardly relative to the lower edges of left side 117 and right side 119, and the upper edges of front 113 and rear 115 may be spaced upwardly relative to the upper edges of left side 117 and right side 119. Consequently, where, for example, front 113 and rear 115 may have a width that is approximately 2 inches greater than the widths of left side 117 and right side 119, the upper edges of front 113 and rear 115 may extend approximately 1 inch above the upper edges of left side 117 and right side 119 to create an air gap of about 1 inch, and the lower edges of front 113 and rear 115 may extend approximately 1 inch below the lower edges of left side 117 and right side 119 to create an air gap of about 1 inch.

Front 113 may be integrally connected along its left vertical edge to left side 117 and may be integrally connected along its right vertical edge to right side 119. Rear 115 may be integrally connected along one vertical edge to left side 117 and may be joined to right side 119 using a panel 133. More specifically, panel 133 may be integrally connected along one vertical edge to rear 115 and may have its outer face secured to the inner face of right side 119 using an adhesive tape (not shown) or other suitable means.

Lower flap 121 may be integrally connected along its front edge to the lower edge of front 113 and may extend generally perpendicularly relative to front 113 (i.e., generally horizontally). Lower flap 123 may be integrally connected along its rear edge to the lower edge of rear 115 and may extend generally perpendicularly relative to rear 115 (i.e., generally horizontally). The rear edge of lower flap 121 and the front edge of lower flap 123 may be secured to one another using an adhesive tape 120 or other suitable means. (In the present embodiment, tape 120 is shown as transparent but need not be.)

Lower flap 125 may be integrally connected along its left edge to the lower edge of left side 117 and may extend generally perpendicularly relative to left side 117 (i.e., generally horizontally). Lower flap 127 may be integrally connected along its right edge to the lower edge of right side 119 and may extend generally perpendicularly relative to right side 119 (i.e., generally horizontally). The right edge of lower flap 125 and the left edge of lower flap 127 may be secured to one another using an adhesive tape 124 or other suitable means. (In the present embodiment, tape 124 is shown as transparent but need not be.) When secured to one another, flaps 125 and 127 may define the lower boundary of a product cavity 128 of product box 111. (In the present embodiment, product cavity 128 may be generally rectangular prismatic in shape but need not be.) A space 135 may be formed below flaps 125 and 127 and above flaps 121 and 123. Space 135, which may be filled with or contain air, may serve to thermally insulate, to a certain extent, the items in cavity 128 of product box 111 from a passive temperature-control member positioned below flaps 121 and 123. This may be advantageous, for example, in circumstances in which the passive temperature-control member, if sitting directly below a conventional product box, would cause the contents of the product box to become too cold. Consequently, such an approach may obviate the need to position materials, like bubble wrap, between the bottom of the product box and the passive temperature-control member to keep the contents of the product box from becoming too cold.

Upper flap 129 may be integrally connected along its front edge to the upper edge of front 113 and may extend generally perpendicularly relative to front 113 (i.e., generally horizontally). Upper flap 131 may be integrally connected along its rear edge to the upper edge of rear 115 and may extend generally perpendicularly relative to the rear 115 (i.e., generally horizontally). The rear edge of upper flap 129 and the front edge of upper flap 131 may be secured to one another using an adhesive tape 126 or other suitable means. (In the present embodiment, tape 126 is shown as transparent but need not be.)

Upper flap 132 may be integrally connected along its left edge to left side 117, and upper flap 134 may be integrally connected along its right edge to right side 119. Upper flap 132 may be folded to form an upper portion 137 extending inwardly from the upper edge of left side 117 and substantially perpendicular to left side 117, a middle portion 139 extending downwardly from the right edge of upper portion 137 and substantially perpendicular to upper portion 137, and a lower portion 141 extending outwardly from the bottom edge of middle portion 139 and substantially perpendicular to middle portion 139. As a result, left side 117 and upper flap 132 may jointly form a double-walled construction. Such a double-walled construction may be filled with or contain air and, in so doing, may form a chamber 142 that may serve to thermally insulate cavity 128 of product box 111.

In a similar manner, upper flap 134 may be folded to form an upper portion 143 extending inwardly from the upper edge of right side 119 and substantially perpendicular to right side 119, a middle portion 145 extending downwardly from the right edge of upper portion 143 and substantially perpendicular to upper portion 143, and a lower portion 147 extending outwardly from the bottom edge of middle portion 145 and substantially perpendicular to middle portion 145. As a result, right side 119 and upper flap 134 may jointly form a double-walled construction. Such a double-walled construction may be filled with or contain air and, in so doing, may form a chamber 144 that may serve to thermally insulate cavity 128 of product box 111.

Due, at least in part, to the fact that the upper edges of front 113 and rear 115 extend above left side 117 and right side 119, when upper flaps 129 and 131 are secured to one another, a space 150 may be formed above cavity 128 in the volume defined, in part, by flaps 129 and 131 and by flaps 132 and 134. Space 150, which may be filled with or contain air, may serve to thermally insulate, to a certain extent, items in product cavity 128 of product box 111 from a passive temperature-control member positioned on top of flaps 129 and 131. This may be advantageous, for example, in circumstances in which the passive temperature-control member, if sitting directly on top of a conventional product box, would cause the contents of the product box to become too cold. Consequently, such an approach may obviate the need to position materials, like bubble wrap, between the top of the product box and the passive temperature-control member to keep the contents of the product box from becoming too cold.

Product box 111 may further comprise a plurality of tabs or wings, a first wing 151 integrally connected to flap 129 and extending outwardly at the interface of front 113 and flap 129, a second wing 153 integrally connected to flap 131 and extending outwardly at the interface of rear 115 and flap 131, a third wing 155 integrally connected to flap 132 and extending outwardly at the interface of left side 117 and flap 132, and a fourth wing 157 integrally connected to flap 134 and extending outwardly at the interface of right side 119 and flap 134. Wings 151, 153, 155, and 157, which may be cut out from front 113, rear 115, left side 117, and right side 119, respectively, may be appropriately dimensioned to engage the inside surfaces of the front, rear, and side walls of an insulated container into which product box 111 may be positioned. This may allow air to circulate around product box 111, thereby minimizing temperature gradients around product box 111. According to one embodiment, wings, 151, 153, 155 and 157 may be dimensioned similarly to one another. In this manner, product box 111 may be generally centered relative to the vertical walls of the insulated container by wings 151, 153, 155 and 157.

Figure 7:
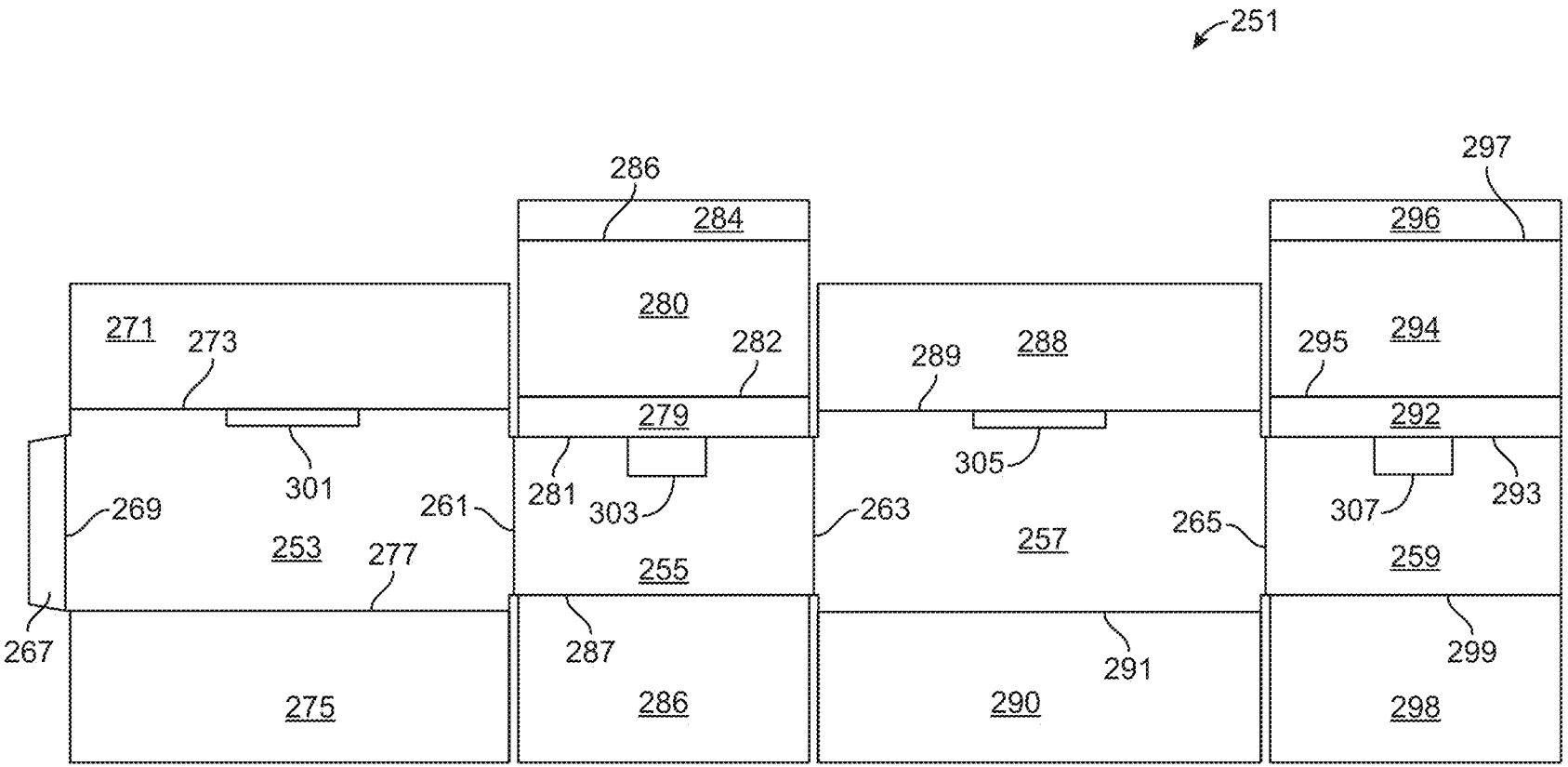
FIG. 7 is a top view of a blank that may be used to form the product box of FIG. 4A.
Figure 8A:
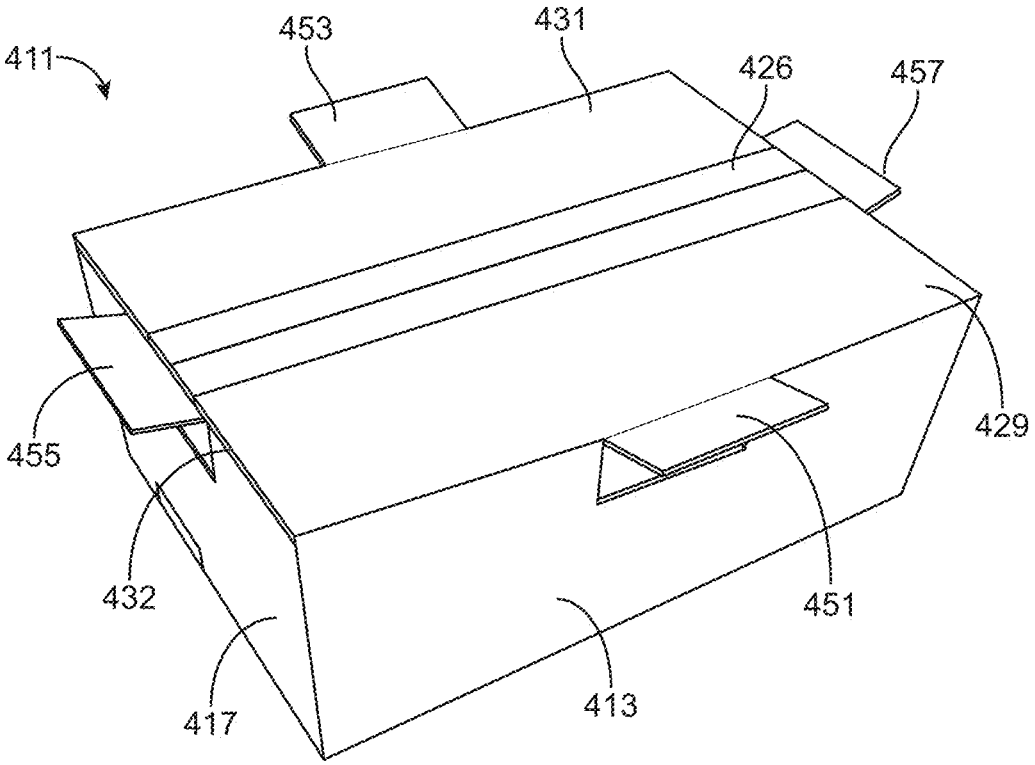
FIGS. 8A through 8D perspective views of a third embodiment of a product box constructed according to the teachings of the present invention, with FIGS. 8A and 8B showing the product box in an upright position and with FIGS. 8C and 8D showing the product box in an inverted position.
Figure 8B:
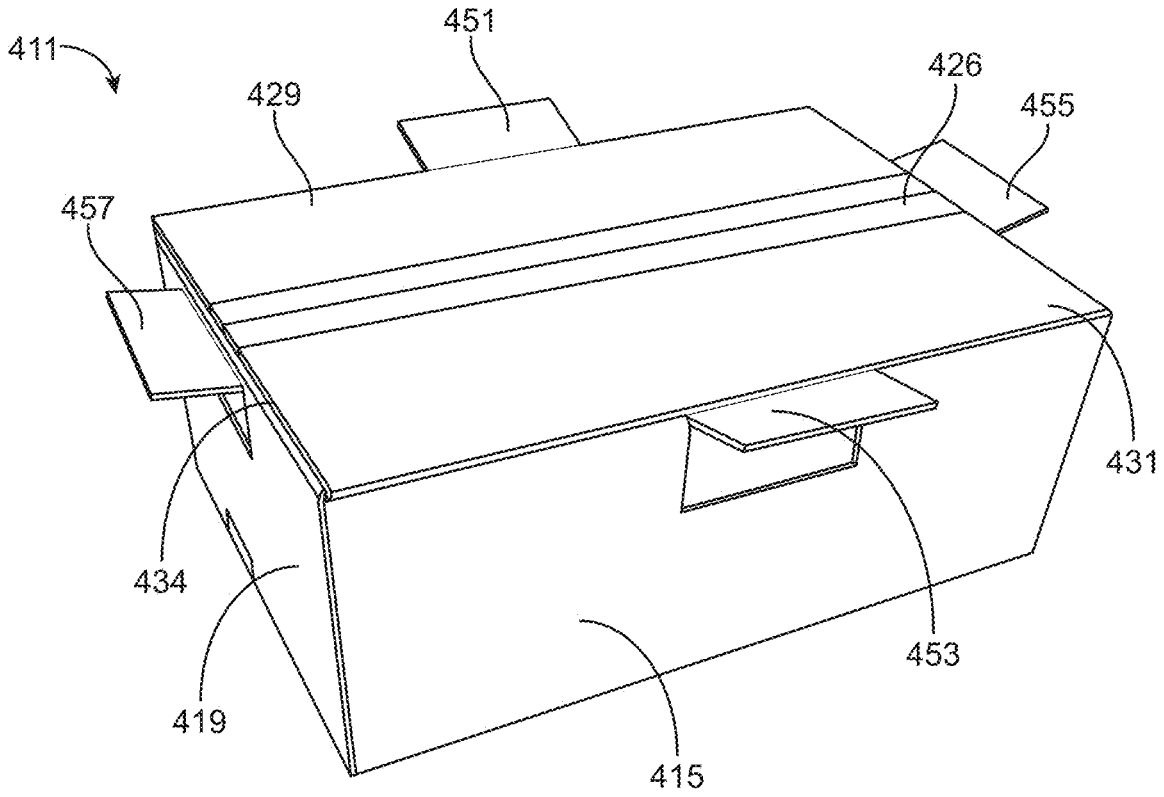
Figure 8C:
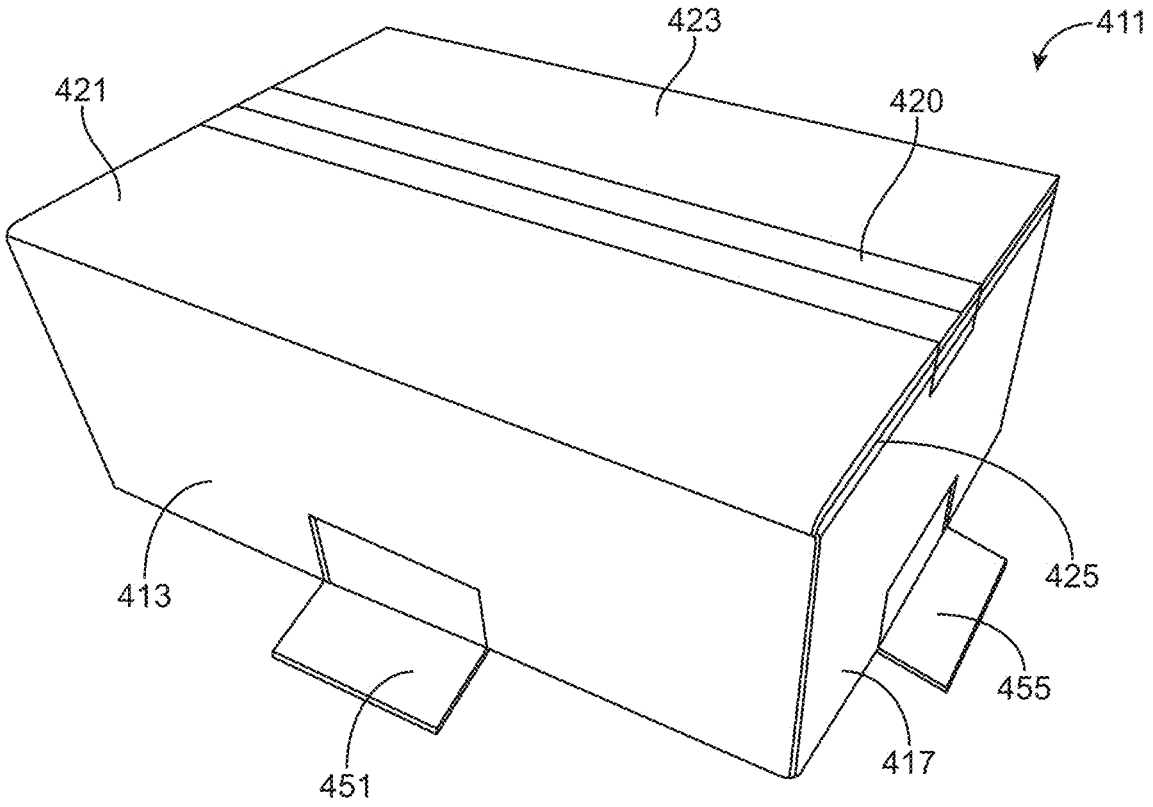
Figure 8D:
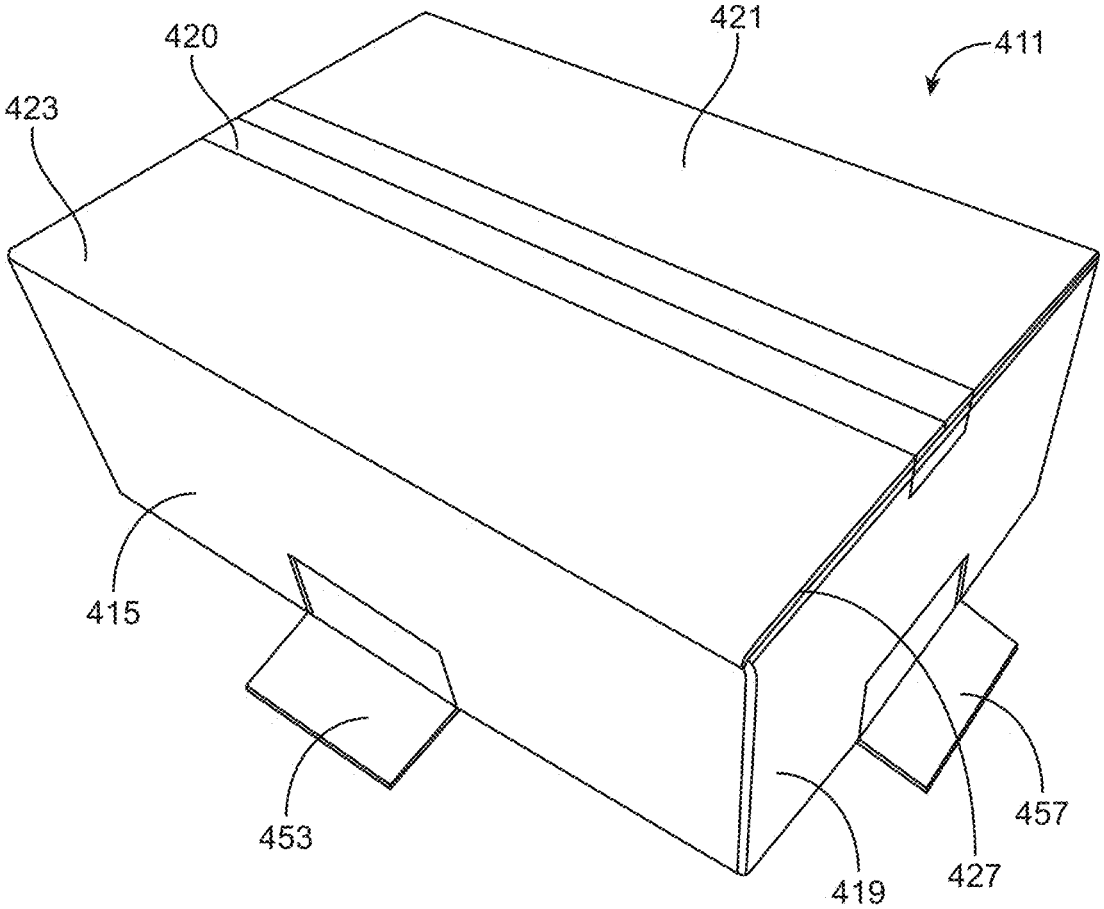
Figure 9A:
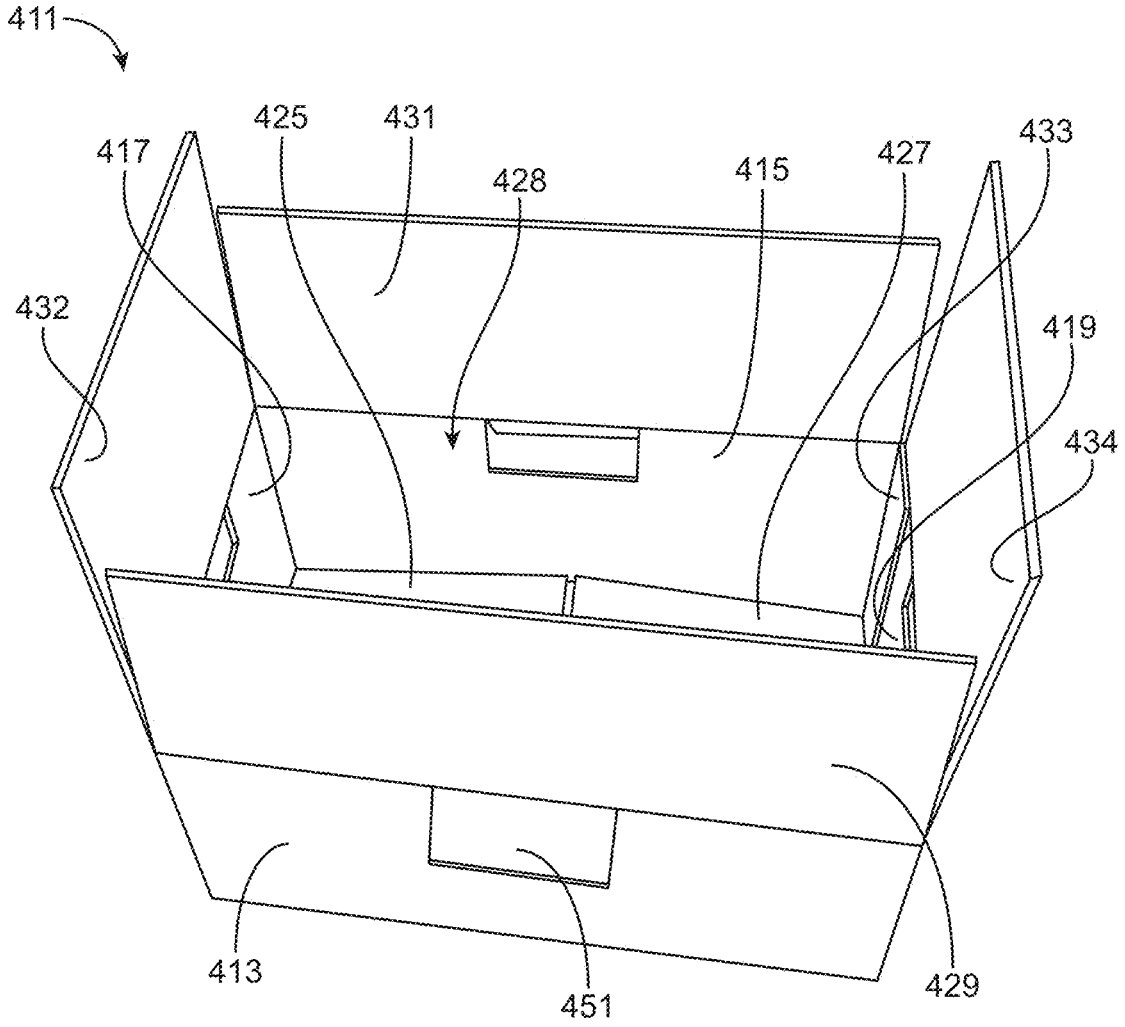
FIGS. 9A and 9B are perspective views of the product box shown in FIG. 8A, with the upper flaps of the product box shown in an open state.
Figure 9B:
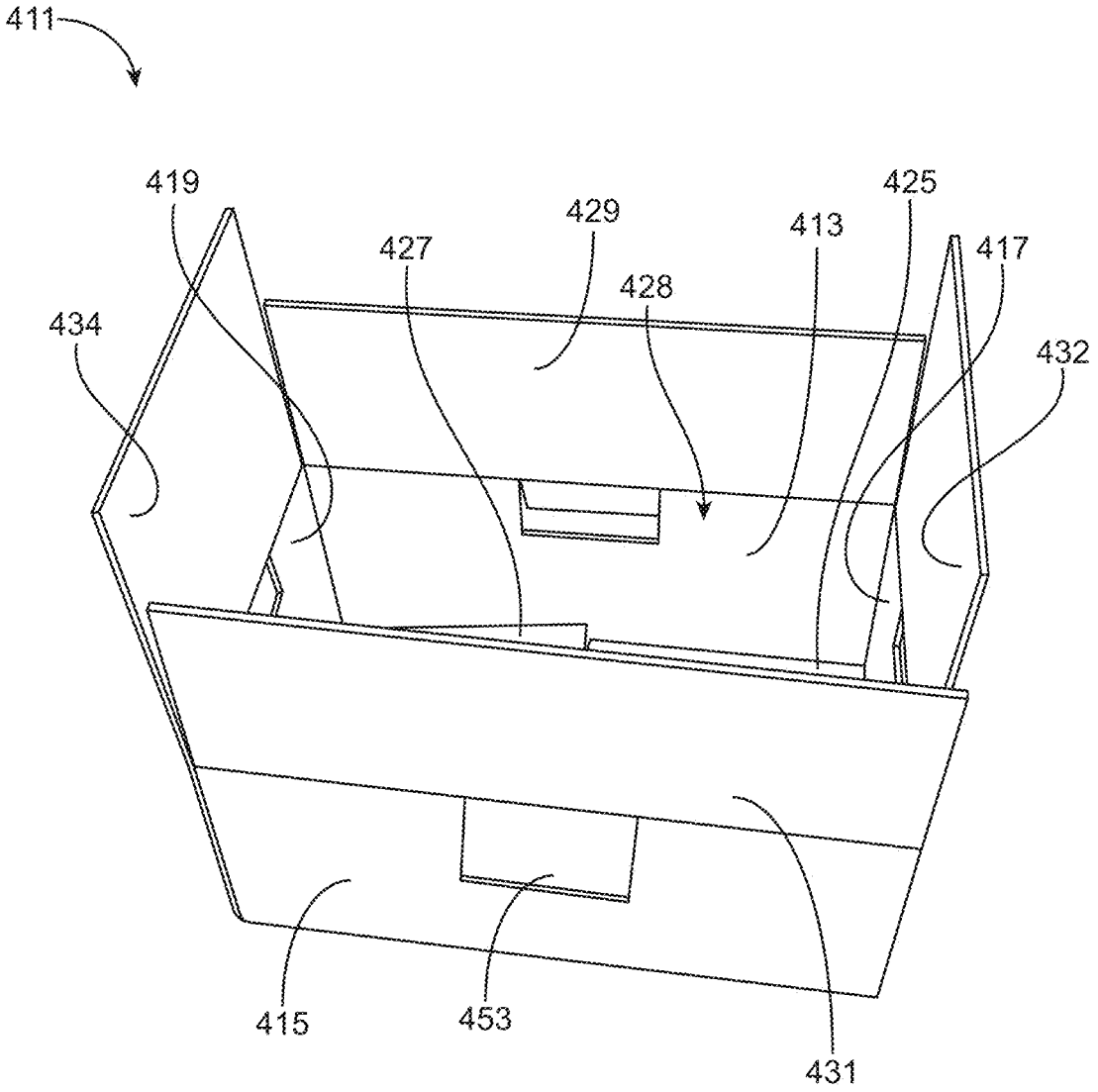

Referring now to FIG. 7, there is shown a top view of a blank that may be used to form product box 111, the blank being constructed according to teachings of the present invention and being represented generally by reference numeral 251. Details of blank 251 that are discussed elsewhere in this application or that are not critical to an understanding of the invention may be omitted from FIG. 7 and/or from the accompanying description herein or may be shown in FIG. 7 and/or described herein in a simplified manner.

Blank 251, which may be a one-piece structure made of corrugated cardboard or a similar material, may be shaped to include a first panel 253, a second panel 255, a third panel 257, and a fourth panel 259. First panel 253 may be hingedly connected along a right side thereof to second panel 255 by a first score line 261, second panel 255 may be hingedly connected along a right side thereof to third panel 257 by a second score line 263, and third panel 257 may be hingedly connected along a right side thereof to fourth panel 259 by a third score line 265. In this manner, first panel 253 may be used to form rear 115, second panel 255 may be used to form left side 117, third panel 257 may be used to form front 113, and fourth panel 255 may be used to form right side 119.

First panel 253 may be hingedly connected along a left side thereof to a fifth panel 267 by a fourth score line 269, may be hingedly connected along a top edge thereof to a sixth panel 271 by a fifth score line 273, and may be hingedly connected along a bottom edge thereof to a seventh panel 275 by a sixth score line 277. Fifth panel 267 may be used to form panel 133, sixth panel 271 may be used to form upper flap 131, and seventh panel 275 may be used to form lower flap 123.

Second panel 255 may be hingedly connected along a top edge thereof to an eighth panel 279 by a seventh score line 281. In turn, eighth panel 279 may be hingedly connected along a top edge thereof to a ninth panel 280 by an eighth score line 282. In turn, ninth panel 280 may be hingedly connected along a top edge thereof to a tenth panel 284 by a ninth score line 286. Eighth panel 279 may be used to form upper portion 137, ninth panel 280 may be used to form middle portion 139, and tenth panel 281 may be used to form lower portion 141. In addition, second panel 255 may also be hingedly connected along a bottom edge thereof to an eleventh panel 286 by a tenth score line 287. Eleventh panel 286 may be used to form lower flap 125.

Third panel 257 may be hingedly connected along a top edge thereof to a twelfth panel 288 by an eleventh score line 289, and third panel 257 may be hingedly connected along a bottom edge thereof to a thirteenth panel 290 by a twelfth score line 291. Twelfth panel 288 may be used to form upper flap 129, and thirteenth panel 290 may be used to form lower flap 121.

Fourth panel 259 may be hingedly connected along a top edge thereof to a fourteenth panel 292 by a fourteenth score line 293. In turn, fourteenth panel 292 may be hingedly connected along a top edge thereof to a fifteenth panel 294 by a fourteenth score line 295. In turn, fifteenth panel 294 may be hingedly connected along a top edge thereof to a sixteenth panel 296 by a fifteenth score line 297. Fourteenth panel 292 may be used to form upper portion 143, fifteenth panel 294 may be used to form middle portion 145, and sixteenth panel 296 may be used to form lower portion 147. In addition, fourth panel 259 may also be hingedly connected along a bottom edge thereof to a seventeenth panel 298 by an eighteenth score line 299. Seventeenth panel 298 may be used to form lower flap 127.

A first U-shaped cut 301 may be provided in first panel 253, first U-shaped cut 301 being used to form wing 153. A second U-shaped cut 303 may be provided in second panel 255, second U-shaped cut 303 being used to form wing 155. A third U-shaped cut 305 may be provided in third panel 257, third U-shaped cut 305 being used to form wing 151. A fourth U-shaped cut 307 may be provided in fourth panel 259, fourth U-shaped cut 307 being used to form wing 157.

Blank 251 may be appropriately dimensioned to make a product box having inner dimensions of 17 inches (length)× 111/8 inches (width)×6 inches (depth). It is to be understood that these dimensions are merely exemplary.

Product box 111 may be used as a part of many different types of shipping systems and may be used to keep payloads within various target temperature ranges, such as, but not limited to, −20° C.+5° C. (frozen), +5° C.+3° C. (refrigerated), and +20° C.+5° C. (room temperature). For example, product box 111 may be disposed within the cavity of an insulated container (which may be made of, for example, expanded polystyrene or the like), which, in turn, may be disposed within an outer container made of, for example, corrugated cardboard or the like. One or more passive temperature-control members may also be positioned within the insulated container in contact with (or near) one or more outer surfaces of product box 111.

Referring now to FIGS. 8A-8D and 9A-9B, there are shown various views of a third embodiment of a product box constructed according to the teachings of the present invention, the product box being represented generally by reference numeral 411. Details of product box 411 that are discussed elsewhere in this application or that are not critical to an understanding of the invention may be omitted from one or more of FIGS. 8A-8D and 9A-9B and/or from the accompanying description herein or may be shown in one or more of FIGS. 8A-8D and 9A-9B and/or described herein in a simplified manner.

Product box 411 may comprise a front 413, a rear 415, a left side 417, a right side 419, a first plurality of lower flaps 421 and 423, a second plurality of lower flaps 425 and 427, a first plurality of upper flaps 429 and 431, and a second plurality of upper flaps 432 and 434.

Front 413 and rear 415 may extend generally vertically and parallel to one another and may have substantially matching lengths and widths. Left side 417 and right side 419 may extend generally vertically and parallel to one another and may have substantially matching lengths and widths. Each of left side 417 and right side 419 may be generally perpendicular to each of front 413 and rear 415. Moreover, the upper and lower edges of front 413, rear 415, left side 417, and right side 419 may be substantially aligned with one another. Consequently, product box 411 may differ from product boxes 11 and 111 in that product box 411 may have four lateral sides (i.e., front 413, rear 415, left side 417, and right side 419) of the same height whereas product boxes 11 and 111 may have two lateral sides that extend above and/or below the other two lateral sides.

Front 413 may be integrally connected along its left vertical edge to left side 417 and may be integrally connected along its right vertical edge to right side 419. Rear 415 may be integrally connected along one vertical edge to left side 417 and may be joined to right side 419 using a panel 433. More specifically, panel 433 may be integrally connected along one vertical edge to rear 415 and may have its outer face secured to the inner face of right side 419 using an adhesive tape (not shown) or other suitable means.

Lower flap 421 may be integrally connected along its front edge to the lower edge of front 413 and may extend generally perpendicularly relative to front 413 (i.e., generally horizontally). Lower flap 423 may be integrally connected along its rear edge to the lower edge of rear 415 and may extend generally perpendicularly relative to rear 415 (i.e., generally horizontally). The rear edge of lower flap 421 and the front edge of lower flap 423 may be secured to one another using an adhesive tape 420 or other suitable means. (In the present embodiment, tape 420 is shown as transparent but need not be.)

Lower flap 425 may be integrally connected along its left edge to the lower edge of left side 417 and may extend generally perpendicularly relative to left side 417. Lower flap 427 may be integrally connected along its right edge to the lower edge of right side 419 and may extend generally perpendicularly relative to right side 419. The right edge of lower flap 425 and the left edge of lower flap 427 may or may not be secured to one another using an adhesive tape or other suitable means. Flaps 425 and 427 may be positioned above flaps 421 and 423 and may define the lower boundary of a product cavity 428 of product box 411. As can be seen, in the present embodiment, product cavity 428 may be a generally rectangular prismatic cavity but need not be.

Upper flap 429 may be integrally connected along its front edge to the upper edge of front 413 and may extend generally perpendicularly relative to front 413. Upper flap 431 may be integrally connected along its rear edge to the upper edge of rear 415 and may extend generally perpendicularly relative to rear 415. The rear edge of upper flap 429 and the front edge of upper flap 431 may be secured to one another using an adhesive tape 426 or other suitable means. (In the present embodiment, tape 426 is shown as transparent but need not be.)

Upper flap 432 may be integrally connected along its left edge to left side 417 and may extend generally perpendicularly relative to left side 417. Upper flap 434 may be integrally connected along its right edge to right side 419 and may extend generally perpendicularly relative to right side 419. Upper flaps 432 and 434 may or may not be secured to one another using an adhesive tape or other suitable means. Flaps 432 and 434 may be positioned below flaps 429 and 431 and may define the upper boundary of product cavity 428.

Product box 411 may further comprise a plurality of tabs or wings, a first wing 451 integrally connected to flap 429 and extending outwardly at the interface of front 413 and flap 429, a second wing 453 integrally connected to flap 431 and extending outwardly at the interface of rear 415 and flap 431, a third wing 455 integrally connected to flap 432 and extending outwardly at the interface of left side 417 and flap 432, and a fourth wing 457 integrally connected to flap 434 and extending outwardly at the interface of right side 419 and flap 434. Wings 451, 453, 455, and 457, which may be cut out from front 413, rear 415, left side 417, and right side 419, respectively, may be appropriately dimensioned to engage the inner front, rear, and side walls of an insulated container into which product box 411 may be positioned and, in so doing, may space front 413, rear 415, left side 417, and right side 419 from the aforementioned walls of the insulated container. This may allow air to circulate around product box 411, thereby minimizing temperature gradients around product box 411. According to one embodiment, wings 451. 453, 455 and 457 may be dimensioned similarly to one another. In this manner, product box 411 may be generally centered relative to the vertical walls of the insulated container by wings 451, 453, 455 and 457.

As can be appreciated, one difference between product box 411 and product boxes 11 and 111 is that product box 411 does not provide for an air gap above, below or to a side of the product cavity.

Product box 411 may be used as a part of many different types of shipping systems and may be used to keep payloads within various target temperature ranges, such as, but not limited to, −20° C.±5° C. (frozen), +5° C. ±3° C. (refrigerated), and +20° C. ±5° C. (room temperature). For example, product box 411 may be disposed within the cavity of an insulated container (which may be made of, for example, expanded polystyrene or the like), which, in turn, may be disposed within an outer container made of, for example, corrugated cardboard or the like. One or more passive temperature-control members may also be positioned within the insulated container in contact with (or near) one or more outer surfaces of product box 411.

Figure 10:
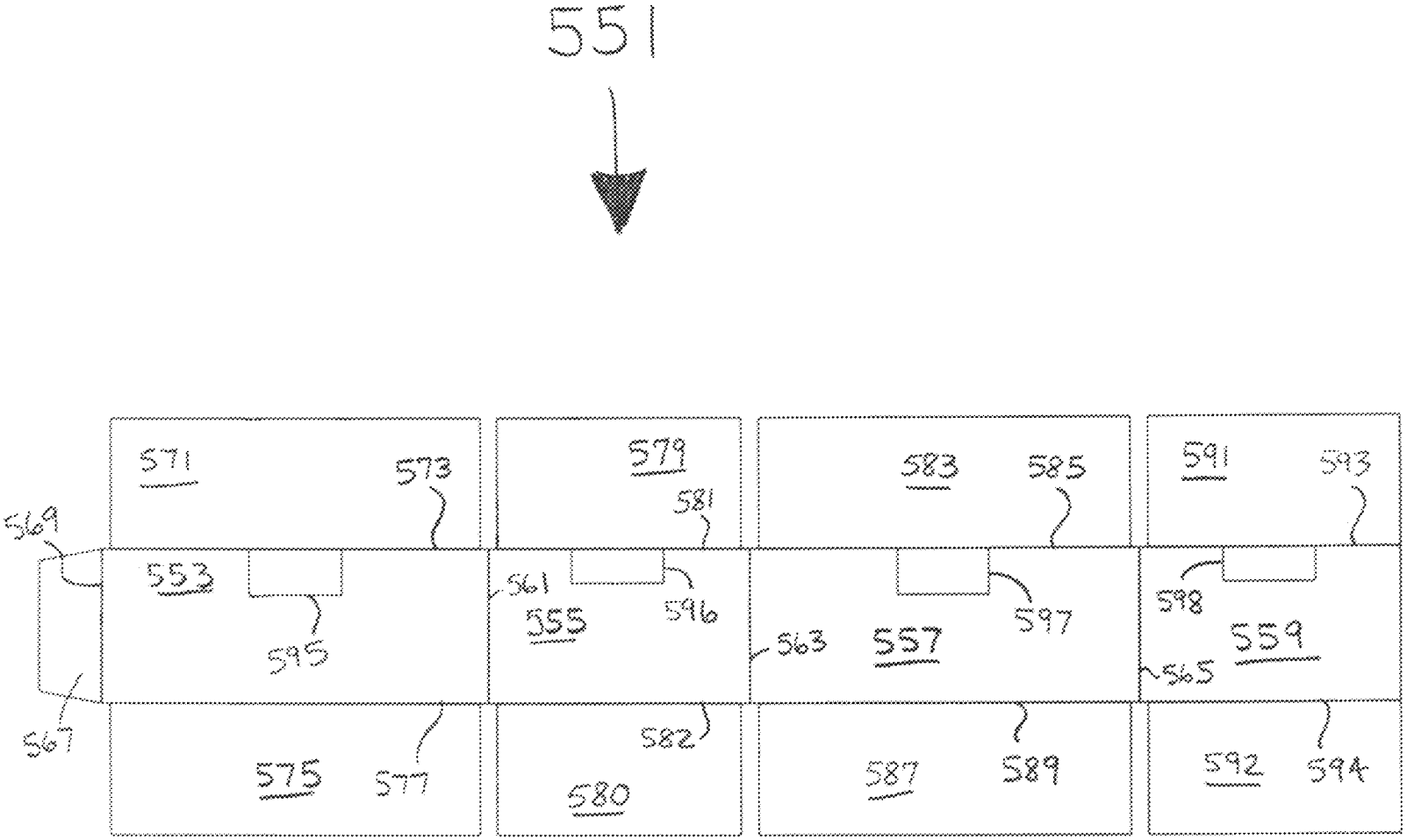
FIG. 10 is a top view of a blank that may be used to form the product box of FIG. 8A.

Referring now to FIG. 10, there is shown a top view of a blank that may be used to form product box 411, the blank being constructed according to teachings of the present invention and being represented generally by reference numeral 551. Details of blank 551 that are discussed elsewhere in this application or that are not critical to an understanding of the invention may be omitted from FIG. 10 and/or from the accompanying description herein or may be shown in FIG. 10 and/or described herein in a simplified manner.

Blank 551, which may be a one-piece structure made of corrugated cardboard or a similar material, may be shaped to include a first panel 553, a second panel 555, a third panel 557, and a fourth panel 559. First panel 553 may be hingedly connected along a right side thereof to second panel 555 by a first score line 561, second panel 555 may be hingedly connected along a right side thereof to third panel 557 by a second score line 563, and third panel 557 may be hingedly connected along a right side thereof to fourth panel 559 by a third score line 565. In this manner, first panel 553 may be used to form rear 415, second panel 555 may be used to form left side 417, third panel 557 may be used to form front 413, and fourth panel 555 may be used to form right side 419.

First panel 553 may be hingedly connected along a left side thereof to a fifth panel 567 by a fourth score line 569. In addition, first panel 553 may be hingedly connected along a top edge thereof to a sixth panel 571 by a fifth score line 573, and first panel 553 may be hingedly connected along a bottom edge thereof to a seventh panel 575 by a sixth score line 577. Fifth panel 567 may be used to form panel 433, sixth panel 571 may be used to form upper flap 431, and seventh panel 575 may be used to form lower flap 423.

Second panel 555 may be hingedly connected along a top edge thereof to an eighth panel 579 by a seventh score line 581. In addition, second panel 555 may be hingedly connected along a bottom edge thereof to a ninth panel 580 by an eighth score line 582. Eighth panel 579 may be used to form upper flap 432, and ninth panel 580 may be used to form lower flap 425.

Third panel 557 may be hingedly connected along a top edge thereof to a tenth panel 583 by a ninth score line 585. In addition, third panel 557 may be hingedly connected along a bottom edge thereof to an eleventh panel 587 by a tenth score line 589. Tenth panel 583 may be used to form upper flap 429, and eleventh panel 587 may be used to form lower flap 421.

Fourth panel 559 may be hingedly connected along a top edge thereof to a twelfth panel 591 by an eleventh score line 593. In addition, fourth panel 559 may be hingedly connected along a bottom edge thereof to a thirteenth panel 592 by a twelfth score line 594. Twelfth panel 591 may be used to form upper flap 434, and thirteenth panel 592 may be used to form lower flap 427.

A first U-shaped cut 595 may be provided in first panel 553, first U-shaped cut 595 being used to form wing 453. A second U-shaped cut 596 may be provided in second panel 555, second U-shaped cut 596 being used to form wing 455. A third U-shaped cut 597 may be provided in third panel 557, third U-shaped cut 597 being used to form wing 451. A fourth U-shaped cut 598 may be provided in fourth panel 559, fourth U-shaped cut 598 being used to form wing 457.

Blank 551 may be appropriately dimensioned to make a product box having inner dimensions of 83/8 inches (length)×5% inches (width)×31/4 inches (depth). It is to be understood that these dimensions are merely exemplary.

As can be appreciated, the product boxes described herein and the blanks used to make such product boxes are merely illustrative.

Figure 11:
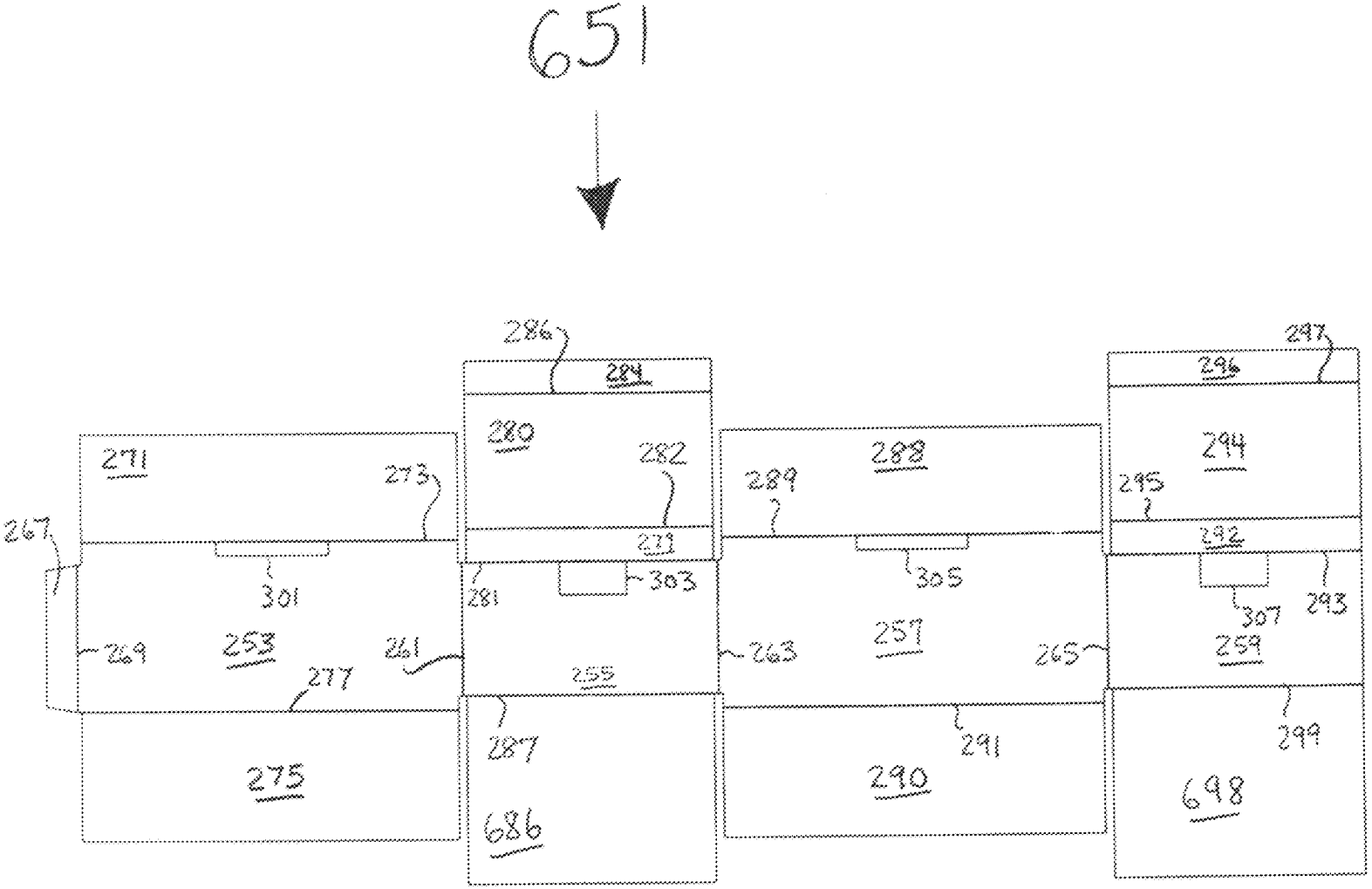
FIG. 11 is a top view of a blank that may be used to form a product box similar to the product box of FIG. 4A.

For example, referring now to FIG. 11, there is shown a top view of an embodiment of a blank that may be used to form a product box that is similar in many respects to product box 111, the blank being constructed according to teachings of the present invention and being represented generally by reference numeral 651. Details of blank 651 that are discussed elsewhere in this application or that are not critical to an understanding of the invention may be omitted from FIG. 11 and/or from the accompanying description herein or may be shown in FIG. 11 and/or described herein in a simplified manner.

Like blank 251, blank 651 may be appropriately dimensioned to make a product box having inner dimensions of 17 inches (length)×111/8 inches (width)×6 inches (depth). Blank 651 may be identical to blank 251, except that, whereas blank 251 may include panels 286 and 298, blank 651 may instead include panels 686 and 698, respectively. As can be seen, each of panels 686 and 698 may have an enlarged width, as compared to panels 286 and 298. Portions of blanks 251 and 651 that may be identical to one another are identified in FIG. 11 with identical reference numbers.

Figure 12A:
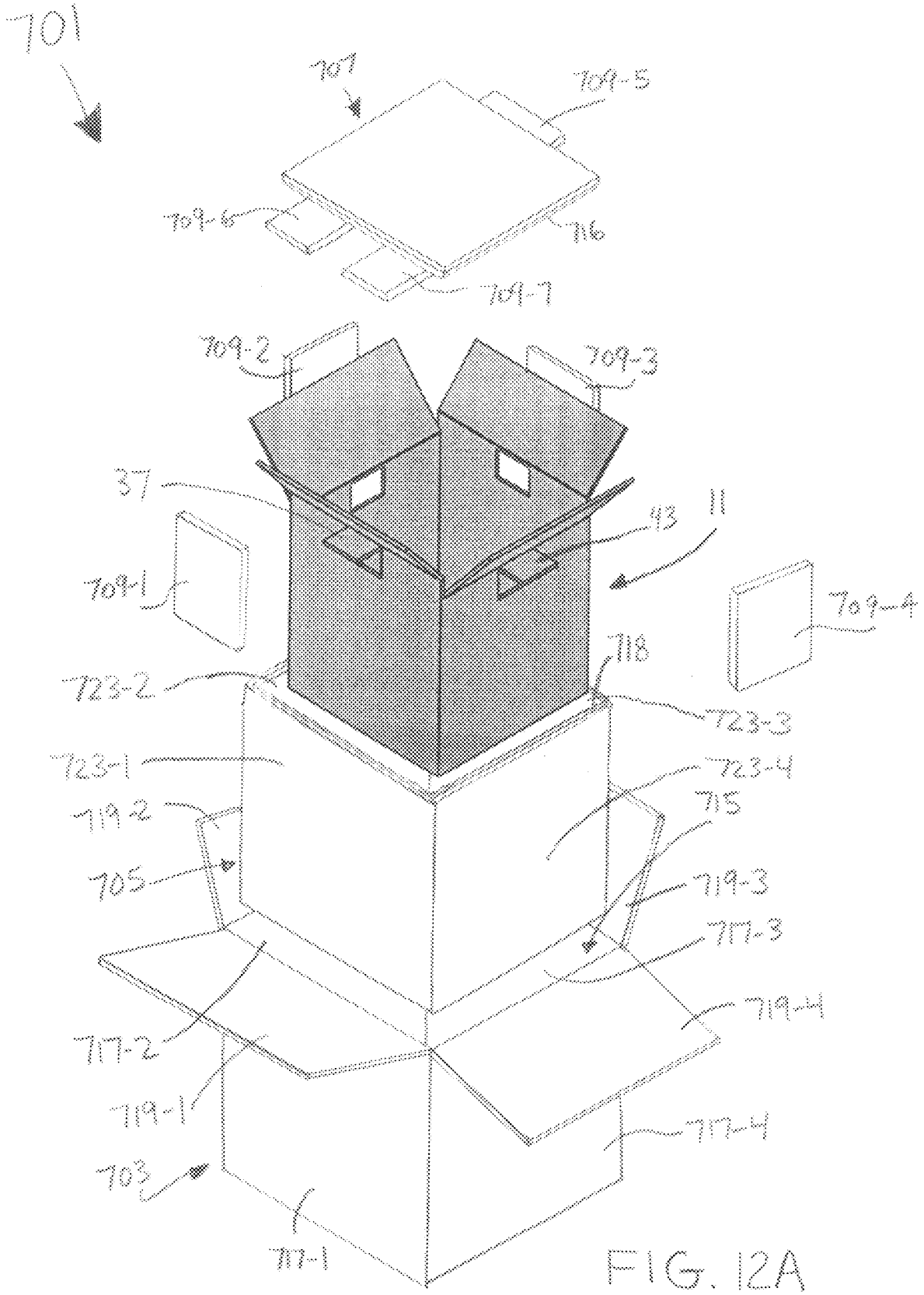
FIGS. 12A and 12B are simplified partly exploded perspective and simplified section views, respectively, of a first embodiment of a shipping system for temperature-sensitive materials constructed according to the teachings of the present invention.
Figure 12B:
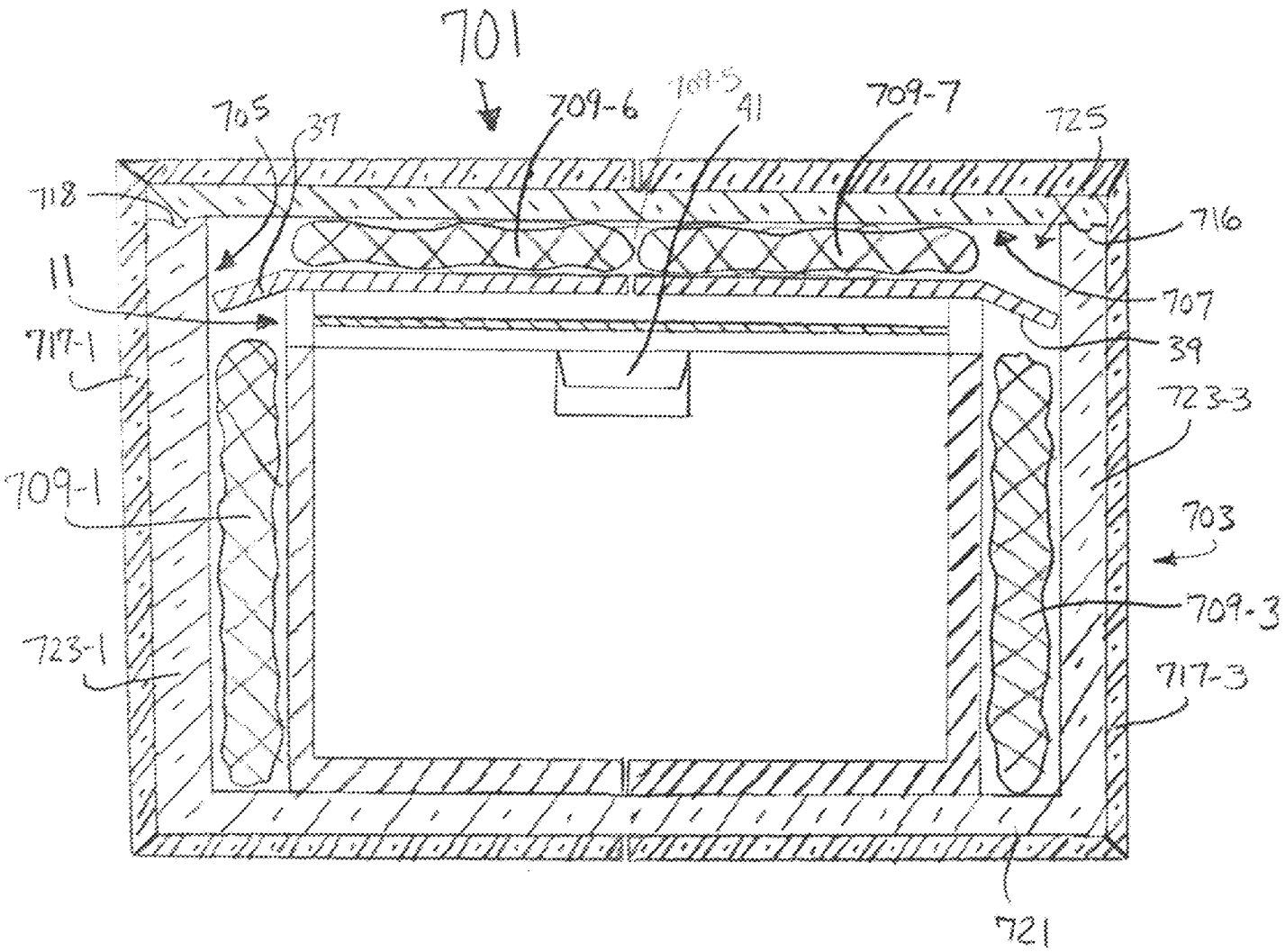

Referring now to FIGS. 12A and 12B, there are shown simplified partly exploded perspective and simplified section views, respectively, of a first embodiment of a shipping system for temperature-sensitive materials, the shipping system being constructed according to teachings of the present invention and being represented generally by reference numeral 701. Details of shipping system 701 that are discussed elsewhere in this application or that are not critical to an understanding of the invention may be omitted from FIGS. 12A and 12B and/or from the accompanying description herein or may be shown in FIGS. 12A and 12B and/or described herein in a simplified manner.

Shipping system 701, which may be used to maintain a payload (e.g., pharmaceuticals, biological materials, medical devices, foods, beverages, etc.) within a desired temperature range, such as between +2° C. and +8° C., when the ambient temperature outside of shipping system 701 is comparatively high (i.e., a summer packout), may comprise an outer container 703, an insulated base 705, an insulated lid 707, product box 11, and a plurality of gel packs 709-1 through 709-7.

Outer container 703 may comprise, for example, a conventional corrugated cardboard box or carton. Outer container 703 may comprise a rectangular prismatic cavity 715 bounded by a plurality of rectangular side walls 717-1 through 717-4, a plurality of bottom closure flaps (not shown), and a plurality of top closure flaps 719-1 through 719-4. Adhesive strips of tape or other closure means (not shown) may be used to retain, in a closed condition, the bottom closure flaps and top closure flaps 719-1 through 719-4.

Insulated base 705 and insulated lid 707 may be removably disposed within cavity 715 of outer container 703 and may be appropriately dimensioned to be snugly received within cavity 715. Insulated base 705 may be made of or comprise expanded polystyrene and/or any other suitable thermal insulating material(s) and may be molded to form a unitary structure comprising a bottom wall 721 and four generally vertical side walls 723-1 through 723-4. Insulated lid 707 may be a unitary structure and may be made of or comprise expanded polystyrene or any other suitable thermal insulating material(s). Insulated lid 707 may be removably mounted on top of insulated base 705, and insulated base 705 and insulated lid 707 may jointly define a cavity 725 of generally rectangular prismatic shape. Insulated base 705 and insulated lid 707 may comprise mating elements, such as complementary tongue 716 and groove 718 structures.

Product box 11 may be removably disposed within cavity 725 and may be seated directly on top of the interior surface of bottom wall 721. Insulated base 705 may be dimensioned relative to product box 11 so that one or more of wings 37, 39, 41 and 43 may be in contact with, or proximate to, one or more corresponding side walls 723-1 through 723-4; however, insulated base 705 need not be so dimensioned.

Gel packs 709-1 through 709-7 may be identical to one another and each may comprise a gelled phase-change material having a phase-change temperature of 0° C. encased in a polymer pouch. For example, each of gel packs 709-1 through 709-7 may be a 600 series KOOLIT® gel pack featuring a polymer ice gel from Cold Chain Technologies, LLC (Franklin, MA). In particular, each of gel packs 709-1 through 709-7 may be a 20.5 oz. gel pack of the aforementioned type, such as 620E KOOLITE® gel pack from Cold Chain Technologies, LLC; however, it is to be understood that the present invention is not limited to any particular type of phase-change material nor is it limited to the type of container therefor. Gel packs 709-1 through 709-4 may be removably disposed in the spaces between the four vertical walls of product box 11 and the four corresponding side walls 723-1 through 723-4 of insulated base 705. Gel packs 709-5 through 709-7 may be removably positioned in a single layer on top of product box 11.

In use, outer container 703, insulated base 705, insulated lid 707, and product box 11 may be preconditioned at +20° C.+5° C.; the payload may be preconditioned at +5° C. +3° C.; and gel packs 709-1 through 709-7 may be preconditioned at −20° C.+5° C. (Gel packs 709-1 through 709-7 are preferably moved from their preconditioning environment to a +20° C.+5° C. environment approximately 30 minutes prior to packout.) The payload may be loaded into product box 11, and product box 11 may be closed. If product box 11 and insulated base 705 are not already loaded into outer container 703, they may be so loaded. Gel packs 709-1 through 709-7 may then be placed on and around product box 11 as indicated above, insulated lid 707 may be placed on top of insulated base 705, and outer container 703 may be closed.

Figure 13A:
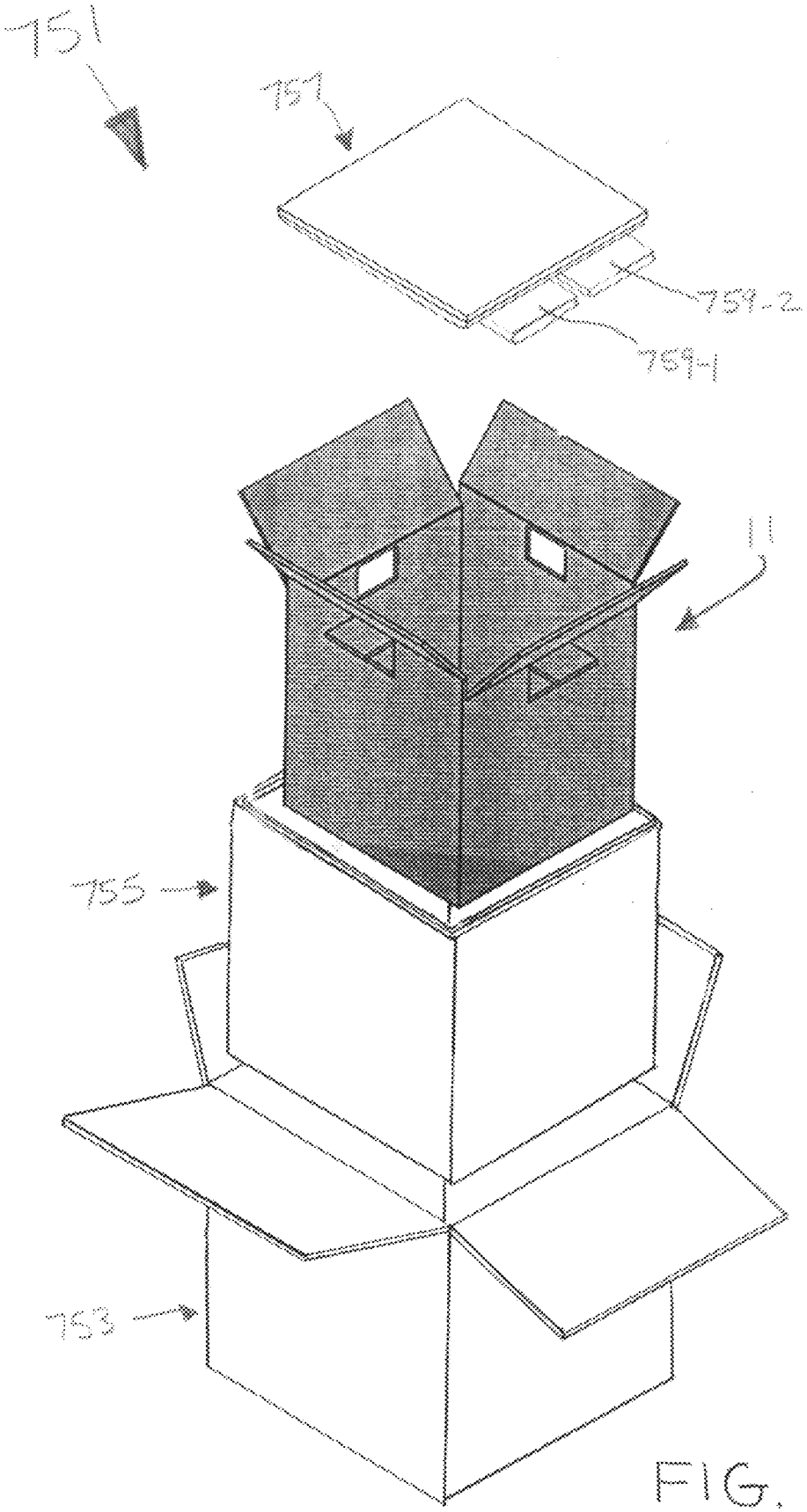
FIGS. 13A and 13B are simplified partly exploded perspective and simplified section views, respectively, of a second embodiment of a shipping system for temperature-sensitive materials constructed according to the teachings of the present invention.
Figure 13B:
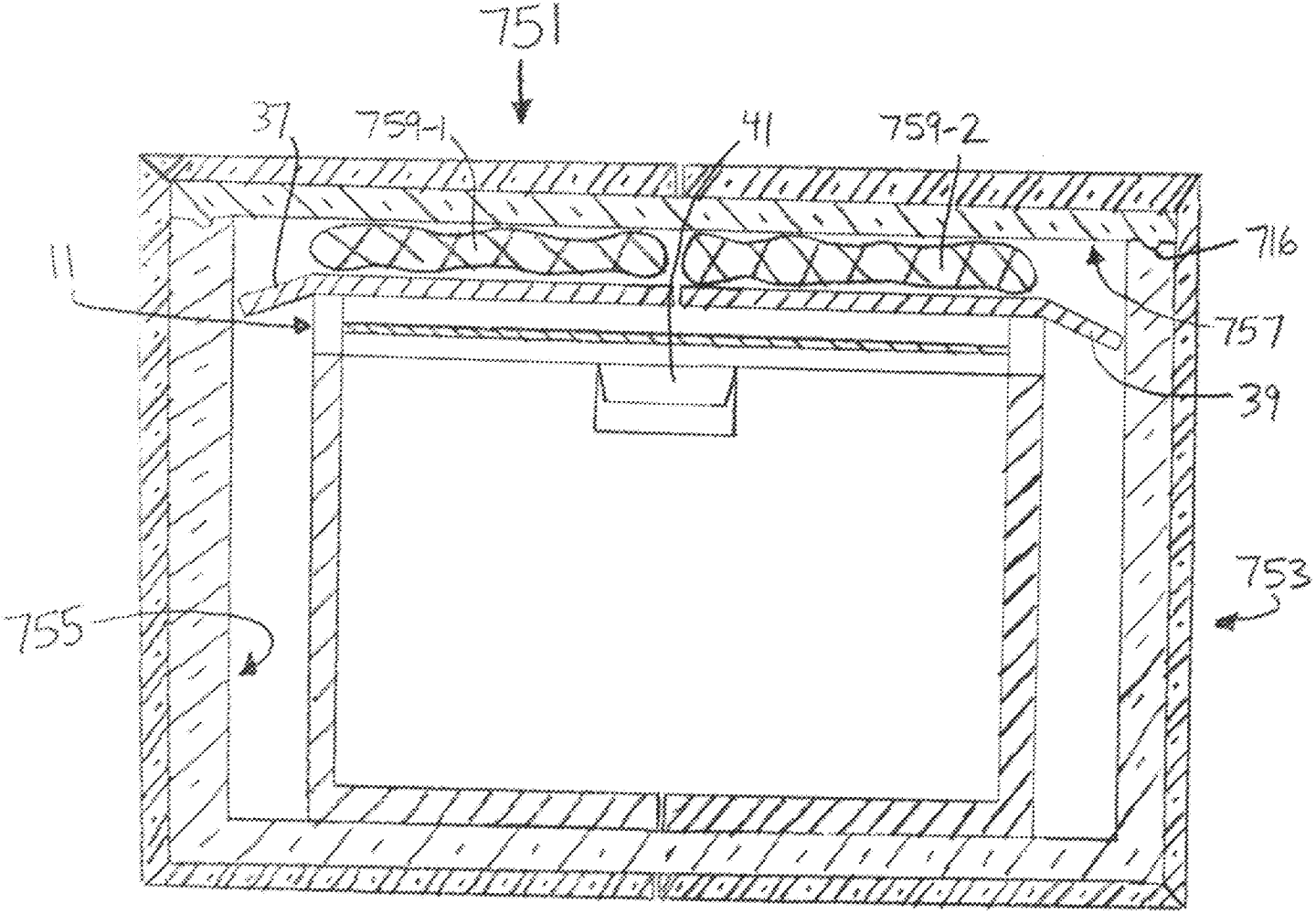

Referring now to FIGS. 13A and 13B, there are shown simplified partly exploded perspective and simplified section views, respectively, of a second embodiment of a shipping system for temperature-sensitive materials, the shipping system being constructed according to teachings of the present invention and being represented generally by reference numeral 751. Details of shipping system 751 that are discussed elsewhere in this application or that are not critical to an understanding of the invention may be omitted from FIGS. 13A and 13B and/or from the accompanying description herein or may be shown in FIGS. 13A and 13B and/or described herein in a simplified manner.

Shipping system 751, which may be used to maintain a payload (e.g., pharmaceuticals, biological materials, medical devices, foods, beverages, etc.) within a desired temperature range, such as between +2° C. and +8° C., when the ambient temperature outside of shipping system 751 is comparatively low (i.e., a winter packout), may comprise an outer container 753, an insulated base 755, an insulated lid 757, product box 11, and a plurality of gel packs 759-1 and 759-2.

Outer container 753 may be identical to outer container 703, insulated base 755 may be identical to insulated base 705, insulated lid 757 may be identical to insulated lid 707, and gel packs 759-1 and 759-2 may be identical to gel packs 709-1 through 709-7.

In use, outer container 753, insulated base 755, insulated lid 757, and product box 11 may be preconditioned at +20° C.+5° C.; the payload may be preconditioned at +5° C. +3° C.; and gel packs 759-1 and 759-2 may be preconditioned at −20° C.+5° C. (Gel packs 759-1 and 759-2 are preferably moved from their preconditioning environment to a +20° C.+5° C. environment approximately 30 minutes prior to packout.) The payload may be loaded into product box 11, and product box 11 may be closed. If product box 11 and insulated base 755 are not already loaded into outer container 753, they may be so loaded. Gel packs 759-1 and 759-2 may then be placed on top of product box 11, insulated lid 757 may be placed on top of insulated base 755, and outer container 753 may be closed.

As can be appreciated, systems 701 and 751 have many of the same types of components, the principal difference between the two systems being that system 701 utilizes seven gel packs (with a frozen gel pack being positioned along each of the four lateral sides of the product box and three frozen gel packs being positioned directly on top of the product box) whereas system 751 utilizes only two gel packs (with both frozen gel packs being positioned directly on top of the product box and no gel packs being positioned along the lateral sides of the product box). In view of the above, one could convert system 701 into system 751 simply by removing some of the gel packs. Alternatively, one could convert system 751 into system 701 by adding gel packs. Alternatively, one could provide a kit including all of the components needed to assemble either system 701 or system 751 and then could use such a kit to assemble system 701 or system 751 as desired.

Figure 14A:
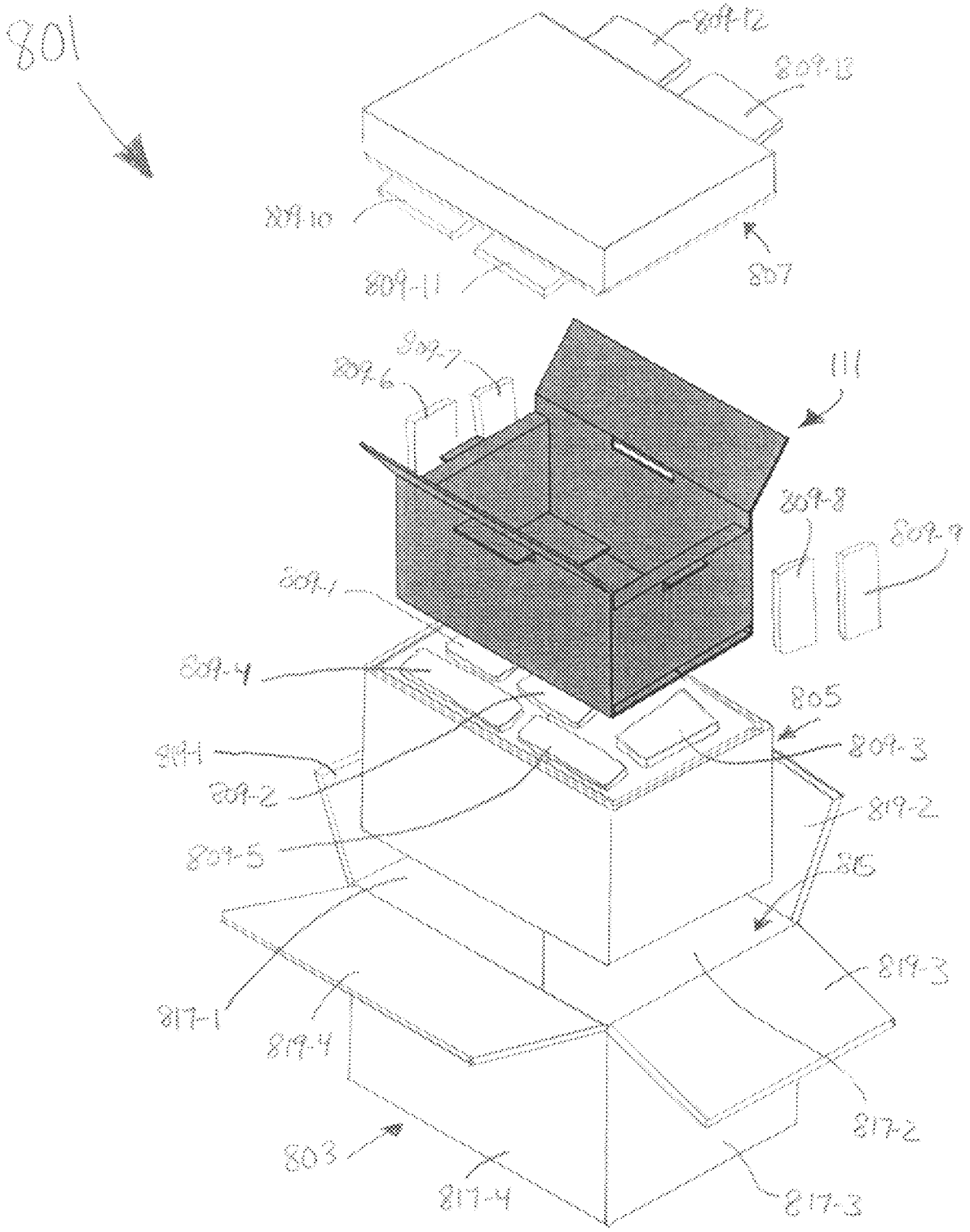
FIGS. 14A and 14B are simplified partly exploded perspective and simplified section views, respectively, of a third embodiment of a shipping system for temperature-sensitive materials constructed according to the teachings of the present invention.
Figure 14B:
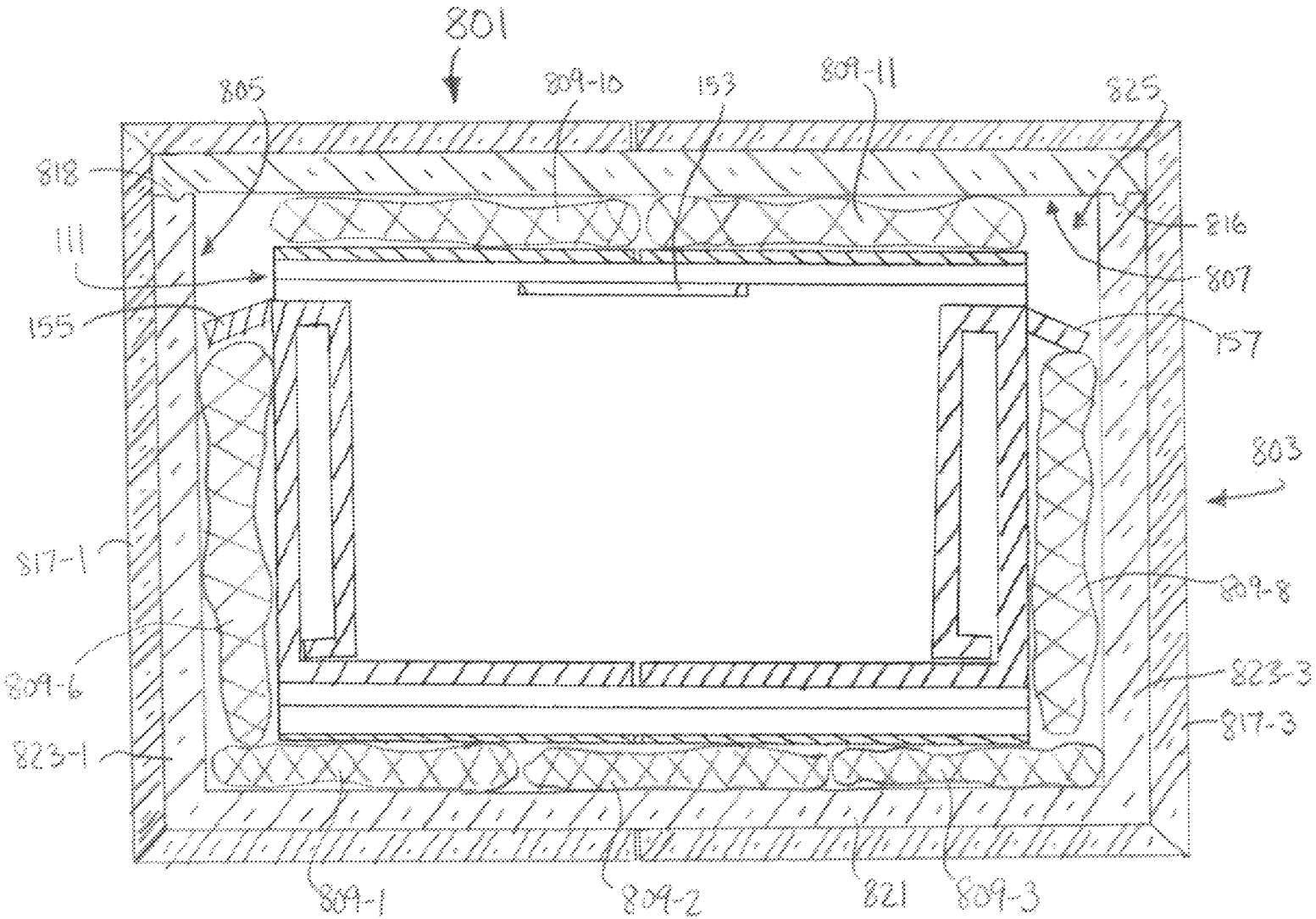

Referring now to FIGS. 14A and 14B, there are shown simplified partly exploded perspective and simplified section views, respectively, of a third embodiment of a shipping system for temperature-sensitive materials, the shipping system being constructed according to teachings of the present invention and being represented generally by reference numeral 801. Details of shipping system 801 that are discussed elsewhere in this application or that are not critical to an understanding of the invention may be omitted from FIGS. 14A and 14B and/or from the accompanying description herein or may be shown in FIGS. 14A and 14B and/or described herein in a simplified manner.

Shipping system 801, which may be used to maintain a payload (e.g., pharmaceuticals, biological materials, medical devices, foods, beverages, etc.) within a desired temperature range, such as between +2° C. and +8° C., when the ambient temperature outside of shipping system 801 is comparatively high (i.e., a summer packout), may comprise an outer container 803, an insulated base 805, an insulated lid 807, product box 111, and a plurality of gel packs 809-1 through 809-13.

Outer container 803 may comprise, for example, a conventional corrugated cardboard box or carton. Outer container 803 may comprise a rectangular prismatic cavity 815 bounded by a plurality of rectangular side walls 817-1 through 817-4, a plurality of bottom closure flaps (not shown), and a plurality of top closure flaps 819-1 through 819-4. Adhesive strips of tape or other closure means (not shown) may be used to retain, in a closed condition, the bottom closure flaps and top closure flaps 819-1 through 819-4.

Insulated base 805 and insulated lid 807 may be removably disposed within cavity 815 of outer container 803 and may be appropriately dimensioned to be snugly received within cavity 815. Insulated base 805 may be made of or comprise expanded polystyrene and/or any other suitable thermal insulating material(s) and may be molded to form a unitary structure comprising a bottom wall 821 and four generally vertical side walls 823-1 through 823-4. Insulated lid 807 may be a unitary structure and may be made of or comprise expanded polystyrene or any other suitable thermal insulating material(s). Insulated lid 807 may be removably mounted on top of insulated base 805, and insulated base 805 and insulated lid 807 may jointly define a cavity 825 of generally rectangular prismatic shape. Insulated base 805 and insulated lid 807 may comprise mating elements, such as complementary tongue 816 and groove 818 structures.

Product box 111 may be removably disposed within cavity 825. Insulated base 805 may be dimensioned relative to product box 111 so that one or more of wings 151, 153, 155 and 157 may be in contact with, or proximate to, one or more corresponding side walls 823-1 through 823-4; however, insulated base 805 need not be so dimensioned.

Gel packs 809-1 through 809-13 may be identical to one another and may be identical to gel packs 709-1 through 709-7 of system 701 or to any other type of phase-change material package. Gel packs 809-1 through 809-5 may be removably disposed in a single layer directly on top of the interior surface of bottom wall 821, with product box 111 seated on top of gel packs 809-1 through 809-5. Gel packs 809-6 and 809-7 may be removably positioned in the space between left side 117 of product box 111 and wall 823-2 of insulated base 805, and gel packs 809-8 and 809-9 may be removably positioned in the space between right side 119 of product box 111 and wall 823-4 of insulated base 805. Gel packs 809-10 through 809-13 may be removably positioned in a single layer centered on top of product box 111.

In use, outer container 803, insulated base 805, insulated lid 807, and product box 111 may be preconditioned at +20° C. ±5° C.; the payload may be preconditioned at +5° C. ±3° C.; and gel packs 809-1 through 809-13 may be preconditioned at −20° C. ±5° C. (Gel packs 809-1 through 809-13 are preferably moved from their preconditioning environment to a +20° C. ±5° C. environment approximately 30 minutes prior to packout.) The payload may be loaded into product box 111, and product box 111 may be closed. If product box 111 and insulated base 805 are not already loaded into outer container 803, they may be so loaded. Gel packs 809-1 through 809-13 may then be placed on and around product box 111 as indicated above, insulated lid 807 may be placed on top of insulated base 805, and outer container 803 may be closed.

Figure 15A:
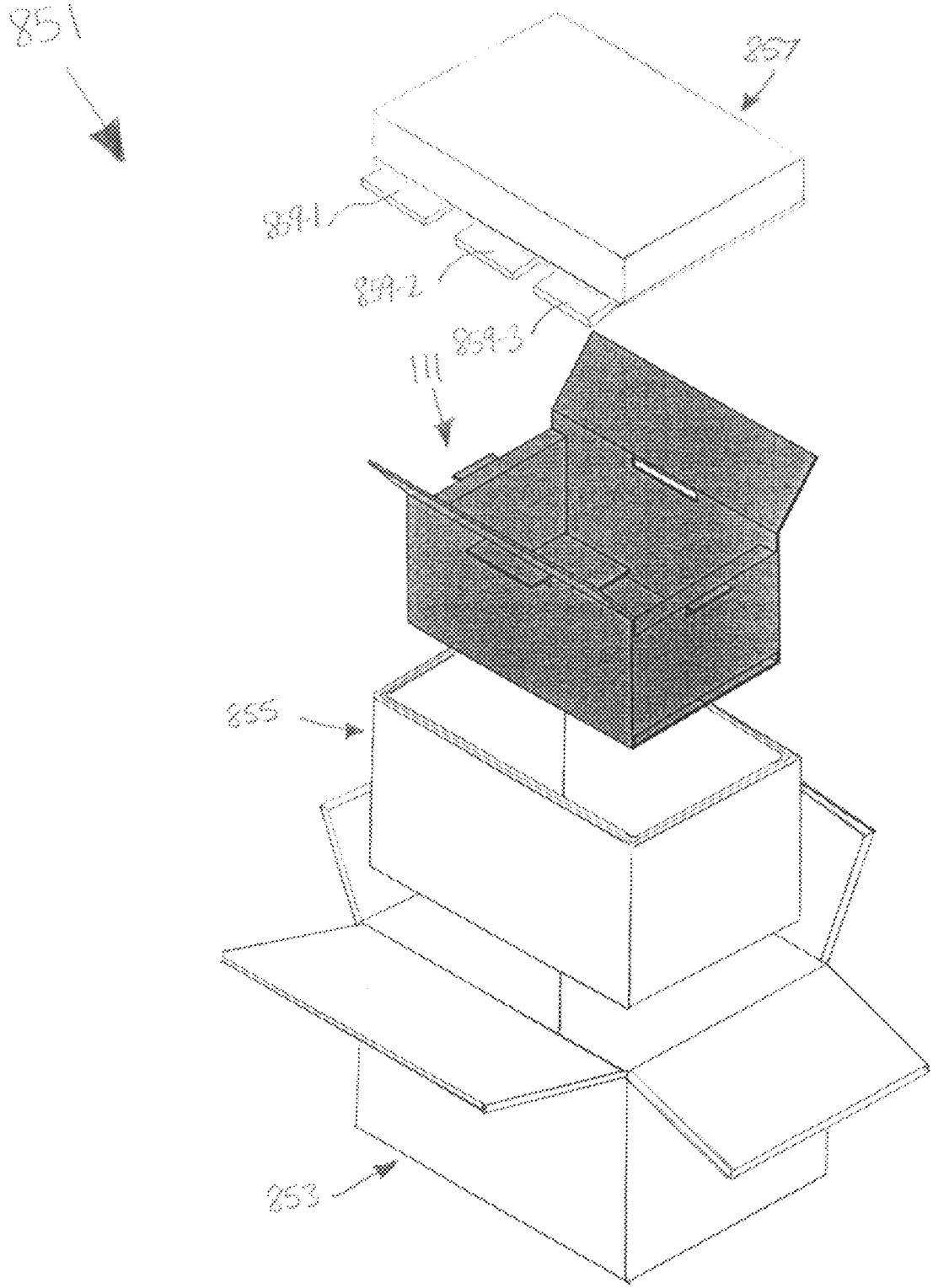
FIGS. 15A and 15B are simplified partly exploded perspective and simplified section views, respectively, of a fourth embodiment of a shipping system for temperature-sensitive materials constructed according to the teachings of the present invention.
Figure 15B:
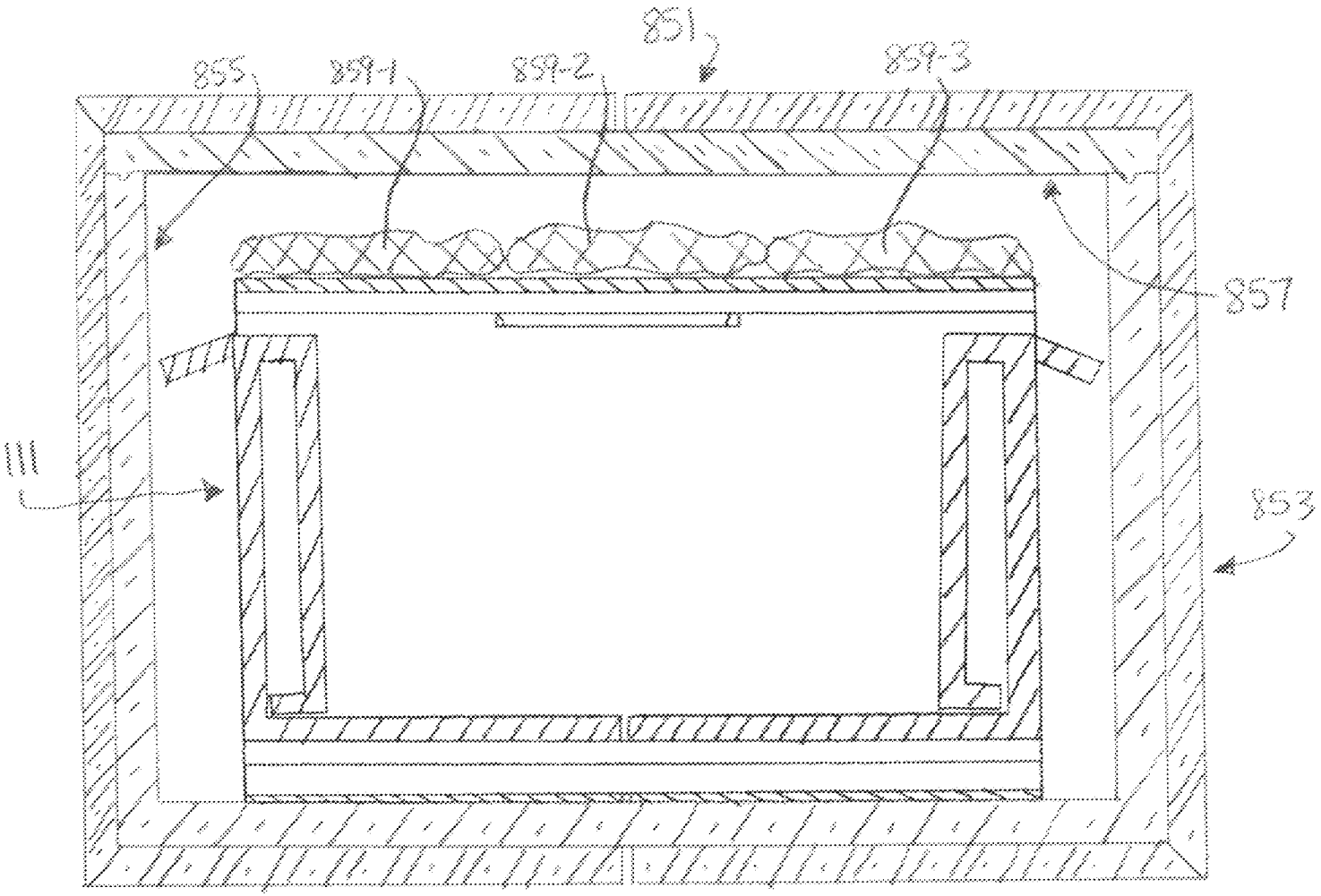

Referring now to FIGS. 15A and 15B, there are shown simplified partly exploded perspective and simplified section views, respectively, of a fourth embodiment of a shipping system for temperature-sensitive materials, the shipping system being constructed according to teachings of the present invention and being represented generally by reference numeral 851. Details of shipping system 851 that are discussed elsewhere in this application or that are not critical to an understanding of the invention may be omitted from FIGS. 15A and 15B and/or from the accompanying description herein or may be shown in FIGS. 15A and 15B and/or described herein in a simplified manner.

Shipping system 851, which may be used to maintain a payload (e.g., pharmaceuticals, biological materials, medical devices, foods, beverages, etc.) within a desired temperature range, such as between +2° C. and +8° C., when the ambient temperature outside of shipping system 851 is comparatively low (i.e., a winter packout), may comprise an outer container 853, an insulated base 855, an insulated lid 857, product box 111, and a plurality of gel packs 859-1 through 859-3.

Outer container 853 may be identical to outer container 803, insulated base 855 may be identical to insulated base 805, insulated lid 857 may be identical to insulated lid 807, and gel packs 859-1 through 859-3 may be identical to gel packs 809-1 through 809-13.

In use, outer container 853, insulated base 855, insulated lid 857, and product box 111 may be preconditioned at +20° C. ±5° C.; the payload may be preconditioned at +5° C. ±3° C.; and gel packs 859-1 through 859-3 may be preconditioned at −20° C. ±5° C. (Gel packs 859-1 through 859-3 are preferably moved from their preconditioning environment to a +20° C. ±5° C. environment approximately 30 minutes prior to packout.) The payload may be loaded into product box 111, and product box 111 may be closed. If product box 111 and insulated base 855 are not already loaded into outer container 853, they may be so loaded. Gel packs 859-1 through 859-3 may then be placed in a single layer centered on top of product box 111, insulated lid 857 may be placed on top of insulated base 855, and outer container 853 may be closed.

As can be appreciated, systems 801 and 851 have many of the same types of components, the principal difference between the two systems being that system 801 utilizes thirteen gel packs (with five frozen gel packs positioned under the product box, two frozen gel packs positioned along each of the left and right sides of the product box, and four frozen gel packs positioned directly on top of the product box) whereas system 851 utilizes only three gel packs (with all three gel packs being positioned directly on top of the product box and no gel packs being positioned under or along any vertical sides of the product box). In view of the above, one could convert system 801 into system 851 simply by removing some of the gel packs. Alternatively, one could convert system 851 into system 801 by adding gel packs. Alternatively, one could provide a kit including all of the components needed to assemble either system 801 or system 851 and then could use such a kit to assemble system 801 or system 851 as desired.

Figure 16A:
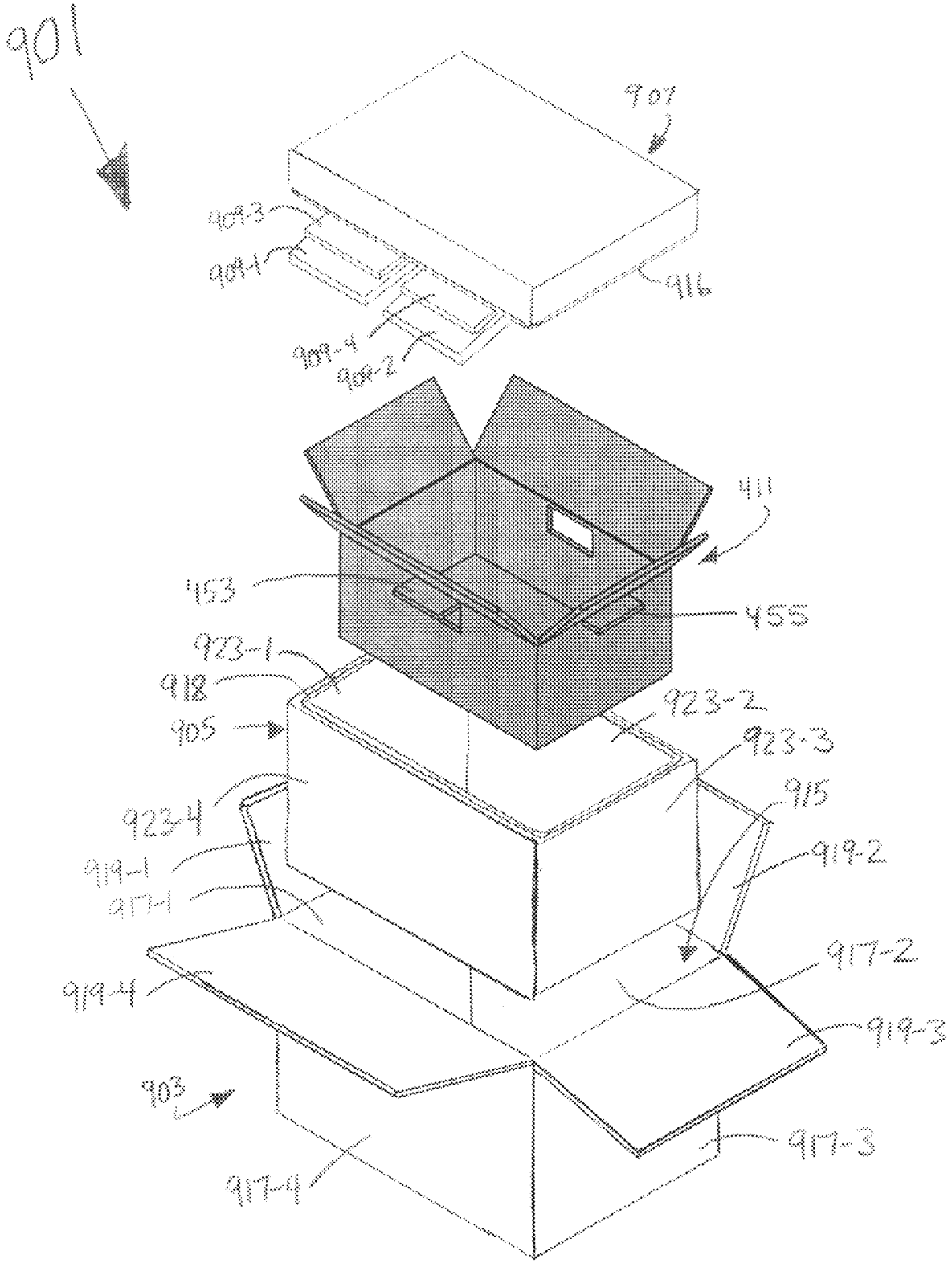
FIGS. 16A and 16B are simplified partly exploded perspective and simplified section views, respectively, of a fifth embodiment of a shipping system for temperature-sensitive materials constructed according to the teachings of the present invention.
Figure 16B:
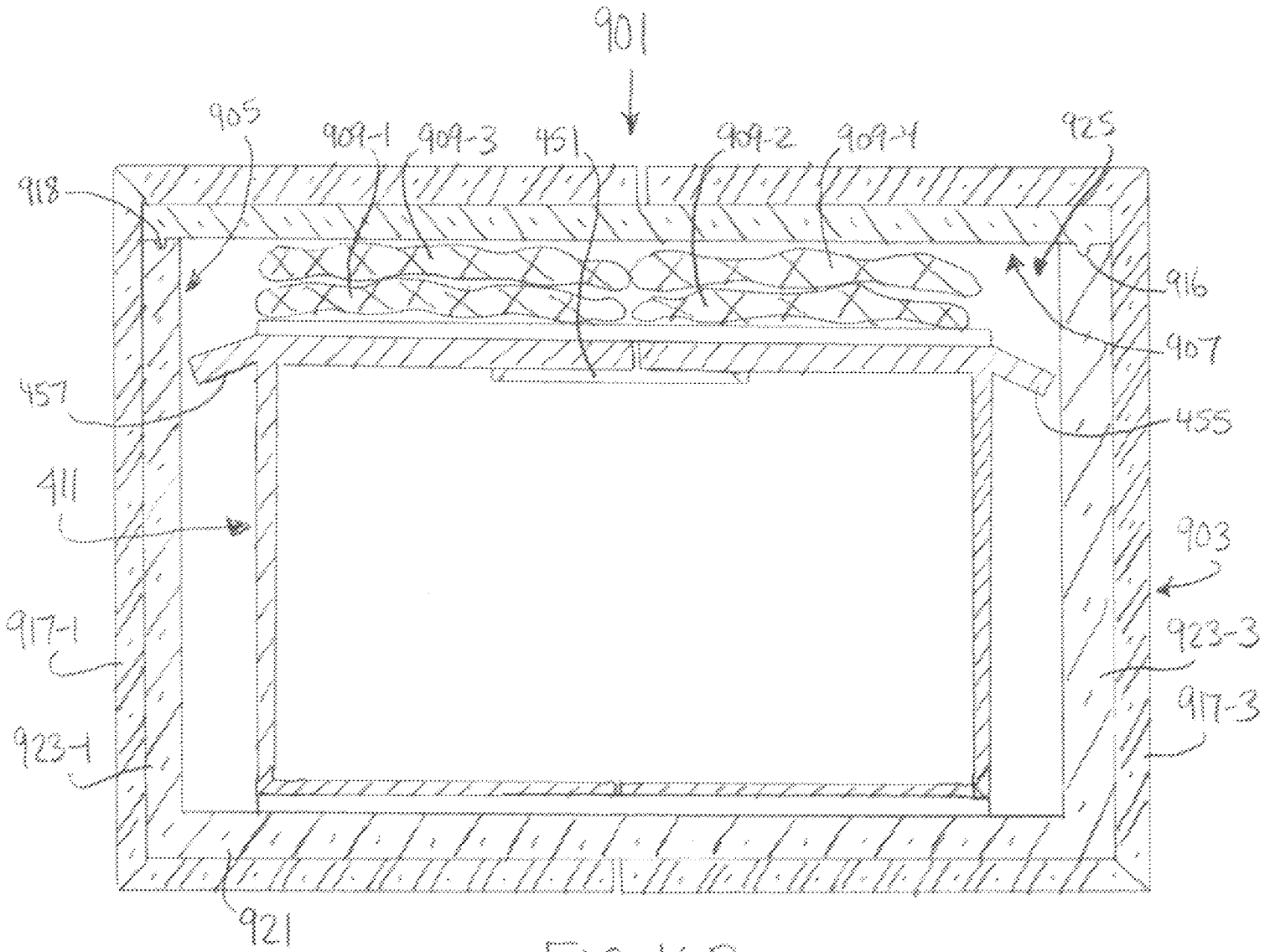

Referring now to FIGS. 16A and 16B, there are shown simplified partly exploded perspective and simplified section views, respectively, of a fifth embodiment of a shipping system for temperature-sensitive materials, the shipping system being constructed according to teachings of the present invention and being represented generally by reference numeral 901. Details of shipping system 901 that are discussed elsewhere in this application or that are not critical to an understanding of the invention may be omitted from FIGS. 16A and 16B and/or from the accompanying description herein or may be shown in FIGS. 16A and 16B and/or described herein in a simplified manner.

Shipping system 901, which may be used to maintain a payload (e.g., pharmaceuticals, biological materials, medical devices, foods, beverages, etc.) within a desired temperature range, such as between +2° C. and +8° C., when the ambient temperature outside of shipping system 901 is comparatively high (i.e., a summer packout), may comprise an outer container 903, an insulated base 905, an insulated lid 907, product box 411, and a plurality of gel packs 909-1 through 909-4.

Outer container 903 may comprise, for example, a conventional corrugated cardboard box or carton. Outer container 903 may comprise a rectangular prismatic cavity 915 bounded by a plurality of rectangular side walls 917-1 through 917-4, a plurality of bottom closure flaps (not shown), and a plurality of top closure flaps 919-1 through 919-4. Adhesive strips of tape or other closure means (not shown) may be used to retain, in a closed condition, the bottom closure flaps and top closure flaps 919-1 through 919-4.

Insulated base 905 and insulated lid 907 may be removably disposed within cavity 915 of outer container 903 and may be appropriately dimensioned to be snugly received within cavity 915. Insulated base 905 may be made of or comprise expanded polystyrene and/or any other suitable thermal insulating material(s) and may be molded to form a unitary structure comprising a bottom wall 921 and four generally vertical side walls 923-1 through 923-4. Insulated lid 907 may be a unitary structure and may be made of or comprise expanded polystyrene or any other suitable thermal insulating material(s). Insulated lid 907 may be removably mounted on top of insulated base 905, and insulated base 905 and insulated lid 907 may jointly define a cavity 925 of generally rectangular prismatic shape. Insulated base 905 and insulated lid 907 may comprise mating elements, such as complementary tongue 916 and groove 918 structures.

Product box 411 may be removably disposed within cavity 925 and may be seated directly on top of the interior surface of bottom wall 921. Insulated base 905 may be dimensioned relative to product box 411 so that one or more of wings 451, 453, 455 and 457 may be in contact with, or proximate to, one or more corresponding side walls 923-1 through 923-4; however, insulated base 905 need not be so dimensioned.

Gel packs 909-1 through 909-4 may be identical to one another and may be identical to gel packs 709-1 through 709-7 or to any other type of phase-change material package. Gel packs 909-1 through 909-4 may be removably disposed in two layers of two packs on top of product box 411.

In use, outer container 903, insulated base 905, insulated lid 907, and product box 411 may be preconditioned at +20° C. ±5° C.; the payload may be preconditioned at +5° C. ±3° C.; and gel packs 909-1 through 909-4 may be preconditioned at −20° C. ±5° C. (Gel packs 909-1 through 909-4 are preferably moved from their preconditioning environment to a +20° C. ±5° C. environment approximately 30 minutes prior to packout.) The payload may be loaded into product box 411, and product box 411 may be closed. If product box 411 and insulated base 905 are not already loaded into outer container 903, they may be so loaded. Gel packs 909-1 through 909-4 may then be placed on product box 411 as indicated above, insulated lid 907 may be placed on top of insulated base 905, and outer container 903 may be closed.

Figure 17A:
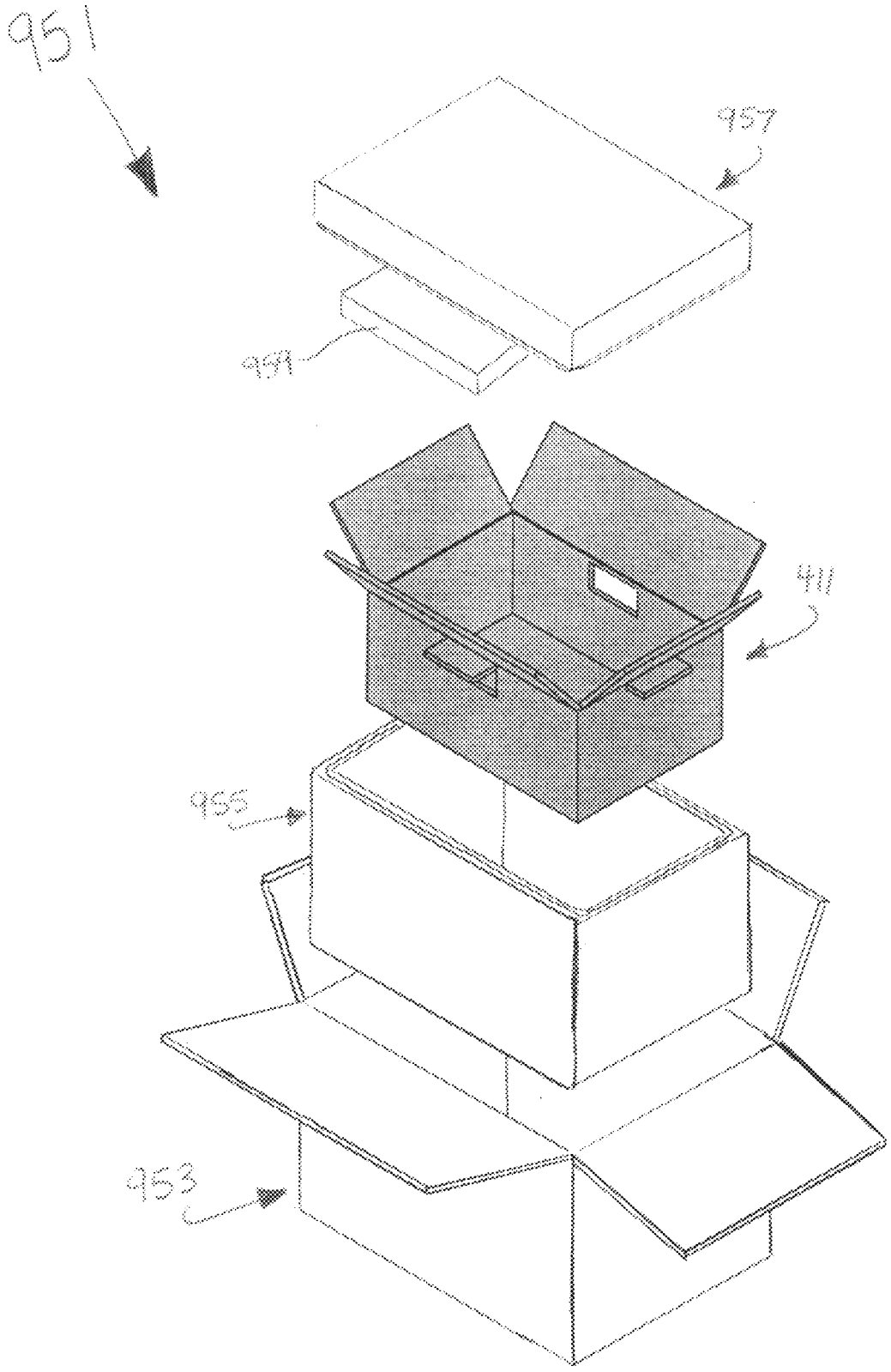
FIGS. 17A and 17B are simplified partly exploded perspective and simplified section views, respectively, of a sixth embodiment of a shipping system for temperature-sensitive materials constructed according to the teachings of the present invention.
Figure 17B:
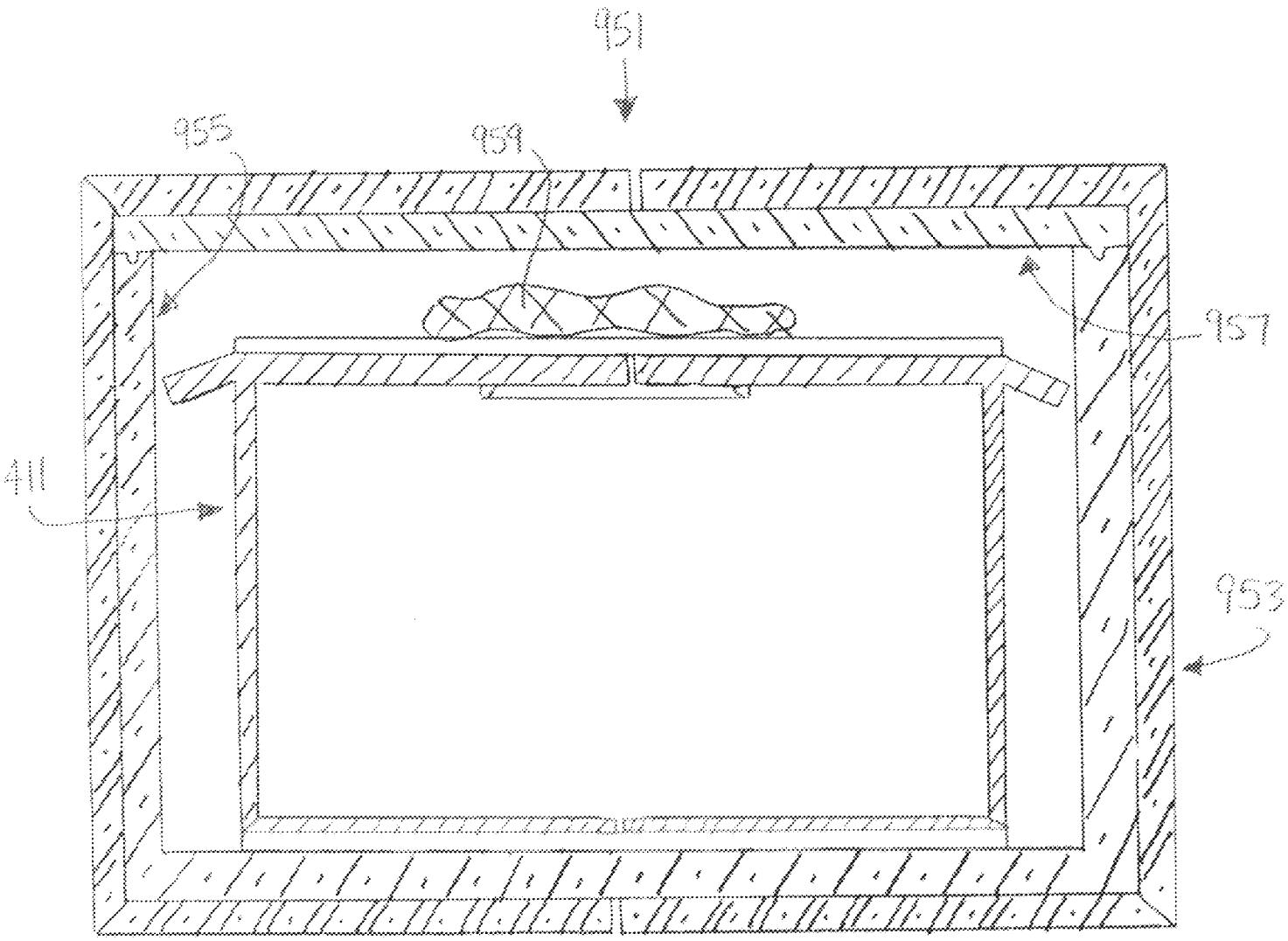

Referring now to FIGS. 17A and 17B, there are shown simplified partly exploded perspective and simplified section views, respectively, of a sixth embodiment of a shipping system for temperature-sensitive materials, the shipping system being constructed according to teachings of the present invention and being represented generally by reference numeral 951. Details of shipping system 951 that are discussed elsewhere in this application or that are not critical to an understanding of the invention may be omitted from FIGS. 17A and 17B and/or from the accompanying description herein or may be shown in FIGS. 17A and 17B and/or described herein in a simplified manner.

Shipping system 951, which may be used to maintain a payload (e.g., pharmaceuticals, biological materials, medical devices, foods, beverages, etc.) within a desired temperature range, such as between +2° C. and +8° C., when the ambient temperature outside of shipping system 951 is comparatively low (i.e., a winter packout), may comprise an outer container 953, an insulated base 955, an insulated lid 957, product box 411, and a gel pack 959.

Outer container 953 may be identical to outer container 903, insulated base 955 may be identical to insulated base 905, insulated lid 957 may be identical to insulated lid 907, and gel pack 959 may be identical to gel packs 909-1 through 909-4.

In use, outer container 953, insulated base 955, insulated lid 957, and product box 411 may be preconditioned at +20° C. ±5° C.; the payload may be preconditioned at +5° C. ±3° C.; and gel pack 959 may be preconditioned at −20° C. ±5° C. (Gel pack 959 is preferably moved from its preconditioning environment to a +20° C. ±5° C. environment approximately 30 minutes prior to packout.) The payload may be loaded into product box 411, and product box 411 may be closed. If product box 411 and insulated base 955 are not already loaded into outer container 953, they may be so loaded. Gel pack 959 may then be placed on top of product box 411, insulated lid 957 may be placed on top of insulated base 955, and outer container 953 may be closed.

As can be appreciated, systems 901 and 951 have many of the same types of components, the principal difference between the two systems being that system 901 utilizes four frozen gel packs positioned in two layers of two packs directly on top of the product box whereas system 951 utilizes only one frozen gel pack positioned directly on top of the product box. In view of the above, one could convert system 901 into system 951 simply by removing some of the gel packs. Alternatively, one could convert system 951 into system 901 by adding gel packs. Alternatively, one could provide a kit including all of the components needed to assemble either system 901 or system 951 and then could use such a kit to assemble system 901 or system 951 as desired.

The present invention provides a number of advantages over existing product boxes and systems using the same. For example, the presence of wings in at least some of the embodiments of the product box helps to keep the product box spaced away from one or more walls of a surrounding container, thereby enabling air to move around the product box and minimizing the presence of thermal gradients. In addition, the presence of an air space above and/or below the product cavity in at least some of the embodiments of the product box helps to keep items within the product cavity from being affected too much by a frozen gel pack or other phase-change material positioned directly on top of and/or under the product box.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A shipping system comprising:

(a) an insulated container;

(b) a product box, the product box disposed within the insulated container, the product box comprising (i) a front, the front comprising an upper edge and a lower edge, (ii) a rear, the rear comprising an upper edge and a lower edge, (iii) a left side, the left side comprising an upper edge and a lower edge, (iv) a right side, the right side comprising an upper edge and a lower edge, (v) a bottom, (vi) a top, and (vii) a set of wings, the set of wings including a first wing, a second wing, a third wing, and a fourth wing, wherein the first wing extends outwardly from the front proximate to the upper edge thereof, the second wing extends outwardly from the rear proximate to the upper edge thereof, the third wing extends outwardly from the left side proximate to the upper edge thereof, and the fourth wing extends outwardly from the right side proximate to the upper edge thereof; and (c) at least one phase-change material package disposed within the insulated container, the at least one phase-change material package comprising a first phase-change material package, the first phase-change material package placed in a space between one of the front, the rear, the left side, and the right side of the product box and an inside surface of the insulated container, the space being maintained at least in part by one of the set of wings.

2. The shipping system as claimed in claim 1 wherein the upper edges of the front and the rear of the product box are higher than the upper edges of the left side and the right side of the product box, wherein the product box further comprises a first closure flap hingedly connected to the upper edge of the front, a second closure flap hingedly connected to the upper edge of the rear, a third closure flap hingedly connected to the upper edge of the left side, and a fourth closure flap hingedly connected to the upper edge of the right side, and wherein, when the first, second, third and fourth closure flaps are closed, an air gap is formed between the first and second closure flaps and the third and fourth closure flaps.

3. The shipping system as claimed in 1 wherein the product box further comprises a first closure flap hingedly connected to the upper edge of the front, a second closure flap hingedly connected to the upper edge of the rear, a third closure flap hingedly connected to the upper edge of the left side, and a fourth closure flap hingedly connected to the upper edge of the right side.

4. The shipping system as claimed in claim 1 wherein the top of the product box comprises a first set of closable flaps, wherein the bottom of the product box comprises a second set of closable flaps, and wherein the at least one phase-change material package further comprises a second phase-change material package, the second phase-change material package being placed in direct contact with one of the top of the product box and the bottom of the product box.

5. A shipping system comprising:

(a) an insulated container;

(b) a product box, the product box disposed within the insulated container, the product box comprising (i) a front, the front comprising an upper edge and a lower edge, (ii) a rear, the rear comprising an upper edge and a lower edge, (iii) a left side, the left side comprising an upper edge and a lower edge, (iv) a right side, the right side comprising an upper edge and a lower edge, wherein the upper edges of the front and the rear are higher than the upper edges of the left side and the right side and/or the lower edges of the front and the rear are lower than the lower edges of the left side and the right side, (v) a first set of closable flaps, the first set of closable flaps including a first flap, a second flap, a third flap, and a fourth flap, wherein the first flap is hingedly connected to the front, the second flap is hingedly connected to the rear, the third flap is hingedly connected to the left side, and the fourth flap is hingedly connected to the right side, wherein the first flap, the second flap, the third flap, and the fourth flap are disposed at the upper edges of the front, the rear, the left side and the right side, respectively, or at the lower edges of the front, the rear, the left side, and the right side, respectively, wherein, when the first, second, third and fourth flaps are closed, a first air gap is formed between the first and second flaps and the third and fourth flaps, and (vi) one or more wings extending outwardly from one or more of the front, the rear, the left side, and the right side and adapted to contact one or more inside surfaces of the insulated container; and (c) at least one phase-change material package disposed within the insulated container, wherein the at least one phase-change material package comprises a first phase-change material package, the first phase-change material package being placed in contact with the first and/or second flap and spaced away from the third and fourth flaps by the air gap.

6. The shipping system as claimed in claim 5 wherein the at least one phase-change material package further comprises a second phase-change material package, the second phase-change material package being placed in a space between one of the front, the rear, the left side, and the right side of the product box and an inside surface of the insulated container, the space being maintained at least in part by a first wing of the one or more the wings.

7. A shipping system comprising:

(a) an insulated container;

(b) a product box, the product box comprising (i) a first pair of opposing sides, wherein each side of the first pair of opposing sides includes a top and a bottom, (ii) a second pair of opposing sides, wherein each side of the second pair of opposing sides includes a top and a bottom and wherein the tops of the sides of the first pair of opposing sides are higher than the tops of the sides of the second pair of opposing sides, (iii) an inner top cover, wherein the inner top cover is aligned with the tops of the sides of the second pair of opposing sides, (iv) an outer top cover, wherein the outer top cover is aligned with the tops of the sides of the first pair of opposing sides, (v) wherein an air gap is formed between the inner top cover and the outer top cover, and (vi) one or more wings extending outwardly from one or more of the front, the rear, the left side, and the right side and adapted to contact one or more inside surfaces of the insulated container; and (c) at least one phase-change material package disposed within the insulated container, wherein the at least one phase-change material package comprises a first phase-change material package, the first phase-change material package being positioned over the outer top cover.

8. The shipping system as claimed in claim 7 wherein the at least one phase-change material package further comprises a second phase-change material package, the second phase-change material package being placed between one of the sides of the first pair and second pair of opposing sides of the product box and an inside surface of the insulated container.

9. A shipping system comprising:

(a) an insulated container;

(b) a product box, the product box comprising (i) a first pair of opposing sides, wherein each side of the first pair of opposing sides includes a top and a bottom, (ii) a second pair of opposing sides, wherein each side of the second pair of opposing sides includes a top and a bottom and wherein the bottoms of the sides of the first pair of opposing sides are lower than the bottoms of the sides of the second pair of opposing sides, (iii) an inner bottom cover, wherein the inner bottom cover is aligned with the bottoms of the sides of the second pair of opposing sides, (iv) an outer bottom cover, wherein the outer bottom cover is aligned with the bottoms of the sides of the first pair of opposing sides, (v) wherein an air gap is formed between the inner bottom cover and the outer bottom cover, and (vi) one or more wings extending outwardly from one or more of the first and second opposing sides and adapted to contact one or more inside surfaces of the insulated container; and (c) at least one phase-change material package disposed within the insulated container, wherein the at least one phase-change material package comprises a first phase-change material package, the first phase-change material package being positioned below the outer bottom cover.

10. The shipping system as claimed in claim 9 wherein the at least one phase-change material package further comprises a second phase-change material package, the second phase-change material package being placed between one of the sides of the first pair and second pair of opposing sides of the product box and an inside surface of the insulated container.

* * * * *